US007946387B2

(12) United States Patent
Betcher et al.

(10) Patent No.: US 7,946,387 B2
(45) Date of Patent: May 24, 2011

(54) SELF-RETRACTING LIFELINE

(75) Inventors: Travis P Betcher, Goodhue, MN (US); Matthew J. Blackford, Hastings, MN (US)

(73) Assignee: D B Industries, Inc., Redwing, MN (US)

( * ) Notice: Subject to any disclaimer, the term of this patent is extended or adjusted under 35 U.S.C. 154(b) by 1005 days.

(21) Appl. No.: 11/619,014

(22) Filed: Jan. 2, 2007

(65) Prior Publication Data

US 2007/0151805 A1 Jul. 5, 2007

Related U.S. Application Data

(60) Provisional application No. 60/755,960, filed on Jan. 3, 2006.

(51) Int. Cl.
*A62B 1/16* (2006.01)

(52) U.S. Cl. ..... 182/231; 182/3; 182/70; 182/73; 182/232; 182/234

(58) Field of Classification Search ..... 182/3, 231, 182/232, 234
See application file for complete search history.

(56) References Cited

U.S. PATENT DOCUMENTS

| | | | | |
|---|---|---|---|---|
| 820,241 | A * | 5/1906 | Cain | 182/234 |
| 2,190,113 | A | 2/1940 | Chreitzberg | |
| 2,317,346 | A | 4/1943 | Reith | |
| 3,022,855 | A * | 2/1962 | Lewis | 182/3 |
| 3,100,669 | A | 8/1963 | Monroe | |
| 3,317,936 | A | 5/1967 | Johnson et al. | |
| 4,065,070 | A | 12/1977 | Pilarski et al. | |
| 4,130,176 | A | 12/1978 | Paulie | |
| 4,135,683 | A | 1/1979 | Stephenson et al. | |
| 4,303,209 | A | 12/1981 | Stephenson | |
| 4,344,589 | A | 8/1982 | Rumpf | |
| 4,394,993 | A | 7/1983 | Stamboulian et al. | |
| 4,420,127 | A | 12/1983 | Kondziola et al. | |
| 4,470,556 | A | 9/1984 | Matsuoka | |
| 4,765,558 | A | 8/1988 | Higbee | |
| 4,877,110 | A | 10/1989 | Wolner | |
| 4,896,844 | A | 1/1990 | Gavagan et al. | |
| 5,287,943 | A | 2/1994 | Bell | |
| 5,522,472 | A | 6/1996 | Shuman, Jr. et al. | |
| 5,611,603 | A * | 3/1997 | Gray et al. | 297/476 |

(Continued)

FOREIGN PATENT DOCUMENTS

WO WO 00/24304 5/2000

*Primary Examiner* — Alvin C Chin-Shue
*Assistant Examiner* — Colleen M Quinn
(74) *Attorney, Agent, or Firm* — IPLM Group, P.A.

(57) ABSTRACT

A self-retracting lifeline includes a common, central brake hub having teeth on opposing sides and a lifeline assembly on each side of the brake hub. The lifeline assemblies include centrifugal clutch assemblies with pawls. The pawls are configured and arranged to engage the teeth of the brake hub to stop the lifeline assemblies when there is a sudden acceleration or a high rate of speed at which the lifeline assemblies turn to pay-out lifeline which causes the pawls to pivot and engage the teeth. The self-retracting lifeline may be operatively connected to a safety harness with a connector interconnecting the bottom of the self-retracting lifeline and the straps of the safety harness proximate a dorsal pad assembly and straps interconnecting the housing of the self-retracting lifeline and the straps of the safety harness above the dorsal pad assembly. The lifelines of the self-retracting lifeline exit the housing proximate the top.

11 Claims, 21 Drawing Sheets

U.S. PATENT DOCUMENTS

| | | | | |
|---|---|---|---|---|
| 5,701,972 | A | 12/1997 | Bloder | |
| 6,073,724 | A | 6/2000 | Wolner et al. | |
| 6,098,746 | A * | 8/2000 | Castaneda | 182/45 |
| 6,283,398 | B1 | 9/2001 | Specht | |
| 6,520,290 | B1 * | 2/2003 | Carter | 182/36 |
| 6,868,941 | B1 * | 3/2005 | Hermann | 182/3 |
| 6,971,476 | B2 * | 12/2005 | Wolner et al. | 182/3 |
| 7,036,628 | B2 * | 5/2006 | Wilcox et al. | 182/9 |
| 7,628,349 | B2 * | 12/2009 | Clute et al. | 242/378.4 |
| 2003/0006094 | A1 | 1/2003 | Cole | |
| 2005/0051659 | A1 | 3/2005 | Wolner et al. | |
| 2005/0145435 | A1 | 7/2005 | Choate | |
| 2005/0263103 | A1 * | 12/2005 | Updyke et al. | 119/796 |
| 2006/0113147 | A1 * | 6/2006 | Harris | 182/3 |
| 2009/0211849 | A1 * | 8/2009 | Smith et al. | 182/231 |
| 2009/0223744 | A1 * | 9/2009 | Dowie | 182/234 |

* cited by examiner

FIG. 2
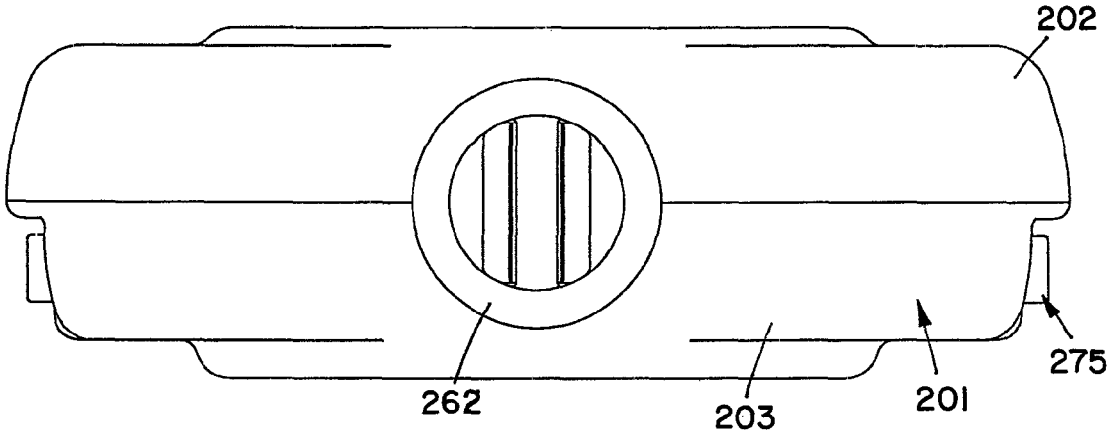
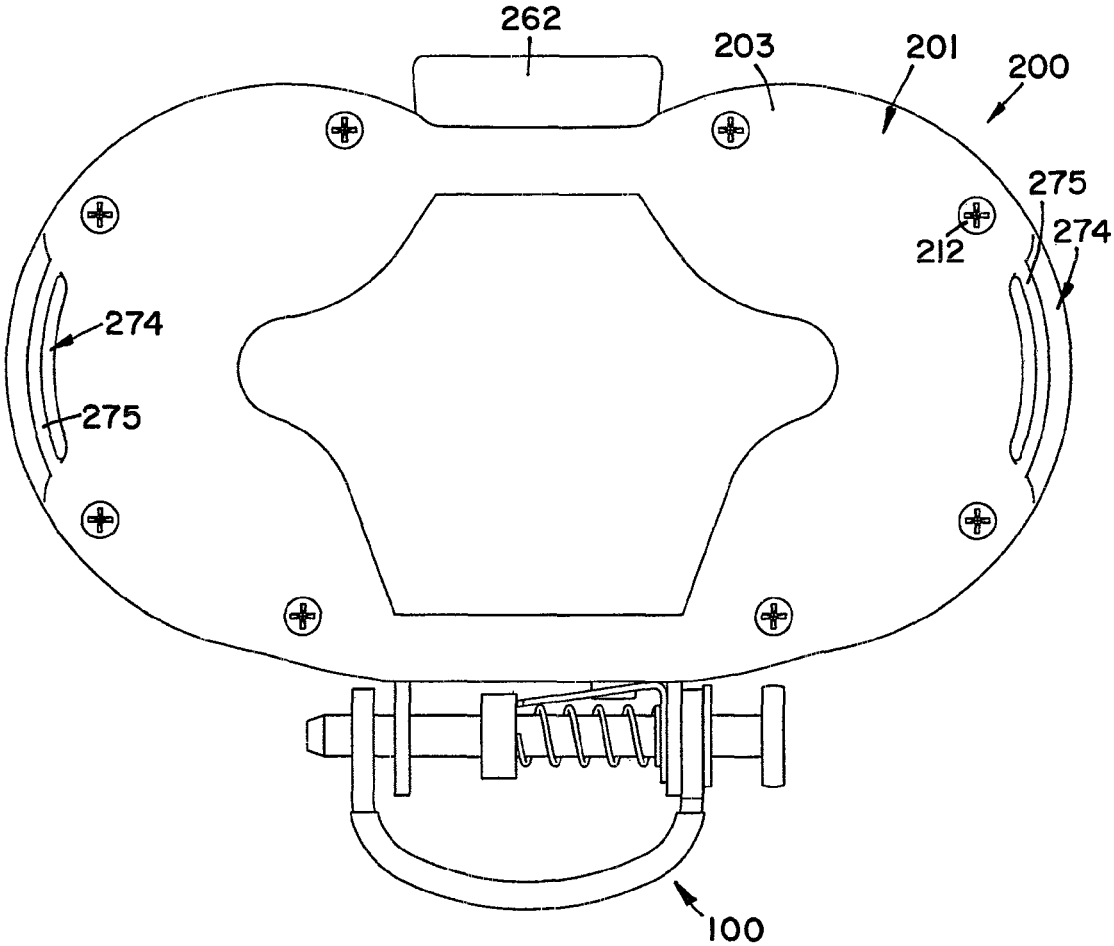
FIG. 1

FIG. 21
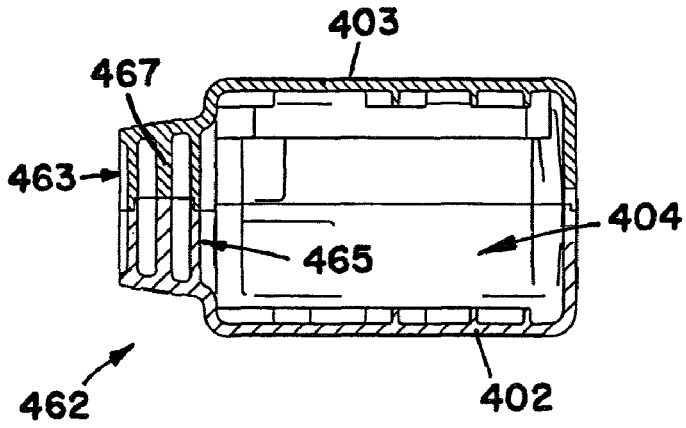
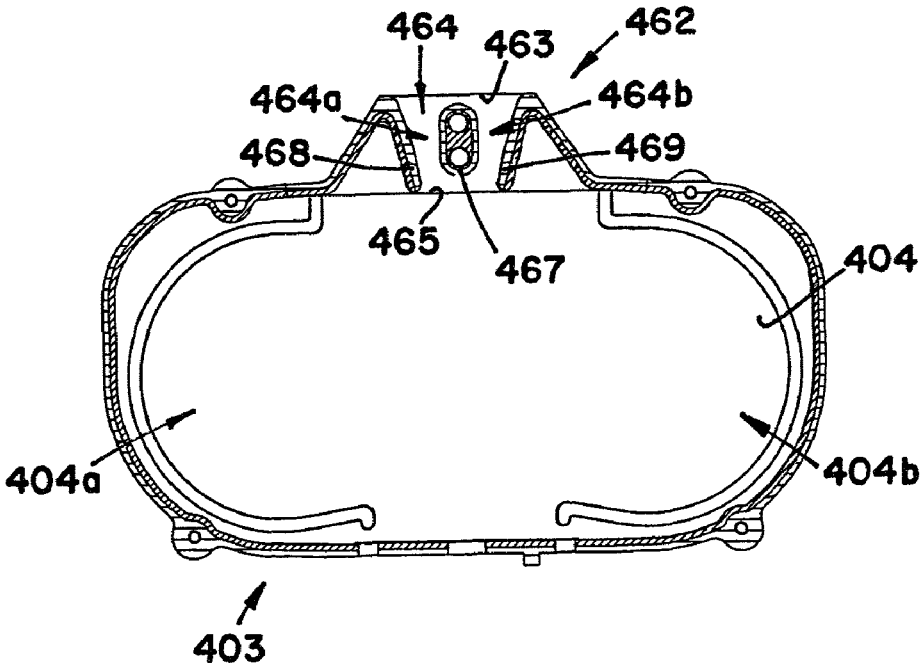
FIG. 22

SELF-RETRACTING LIFELINE

This application claims the benefit of U.S. Provisional Application No. 60/755,960, filed Jan. 3, 2006.

FIELD OF THE INVENTION

The present invention relates to a self-retracting lifeline.

BACKGROUND OF THE INVENTION

Self-retracting lifelines are well known in the art of fall protection safety equipment for use by workers performing tasks during which there is a risk a fall may occur. Self-retracting lifelines generally include a housing containing a drum around which a cable, rope, webbing, or other suitable lifeline is wound. The drum is spring biased to pay out cable as tension pulling the cable is applied and to retract any of the cable that has been unwound from the drum as the tension on the cable is reduced or released. The housing also includes a brake assembly for stopping rotation of the drum when the cable suddenly unwinds from the drum at a rate greater than a predetermined maximum angular velocity.

A self-retracting lifeline is typically connected to a support structure within the vicinity the worker is performing the task, and the end of the cable is typically connected to a safety harness worn by the worker. The support structure may include one or more structures. The cable is easily drawn out of the self-retracting lifeline housing as the worker moves away from the device, and the cable is automatically drawn back into the housing as the worker moves toward the device. Should a fall occur, the brake assembly within the device is automatically engaged by a centrifugal clutch assembly, which gradually and quickly stops the worker's fall by gradually and quickly stopping the rotation of the drum. As the rotation of the drum is stopped, additional cable is prevented from being paid out of the housing to stop the fall of the worker.

Some tasks require the worker to move from one work area to another work area a distance greater than the length of the self-retracting lifeline's cable. In such instances, workers typically use what is termed "twin leg" shock-absorbing lanyards because the lanyards include two lifelines. The two lifelines allow the worker to move from one work area to another work area without being disconnected from the support structure because at least one of the two lifelines is connected to the support structure thus protecting the worker should a fall occur. More specifically, the first lifeline is connected to the support structure while the second lifeline is disconnected and then connected to the support structure closer to the desired work area. Then, the first lifeline is disconnected from the support structure and then connected closer to the desired work area. The disconnecting and connecting of the two lifelines is alternated in such a manner until the desired work area is reached. This is termed "100% tie-off".

The present invention addresses the problems associated with the prior art devices and provides for a self-retracting lifeline.

SUMMARY OF THE INVENTION

In one aspect of the invention, a self-retracting lifeline assembly comprises a brake hub, a first lifeline assembly, and a second lifeline assembly. The brake hub includes teeth on opposing first and second sides. The first lifeline assembly includes a first lifeline wound about a first drum and a first centrifugal clutch assembly with a first pawl operatively connected to the first drum. The first drum is rotatable to pay-out the first lifeline. The first pawl is pivotable and configured and arranged to engage at least one of the teeth proximate the first side of the brake hub when the first pawl pivots in a first outward direction. Sudden acceleration of the first drum causes the first pawl to pivot in the first outward direction to engage the at lease one of the teeth thereby stopping rotation of the first drum and preventing additional pay-out of the first lifeline. The second lifeline assembly includes a second lifeline wound about a second drum and a second centrifugal clutch assembly with a second pawl operatively connected to the second drum. The second drum is rotatable to pay-out the second lifeline. The second pawl is pivotable and configured and arranged to engage at least one of the teeth proximate the second side of the brake hub when the second pawl pivots in a second outward direction. Sudden acceleration of the second drum causes the second pawl to pivot in the second outward direction to engage the at lease one of the teeth thereby stopping rotation of the second drum and preventing additional pay-out of the second lifeline.

In another aspect of the invention, a self-retracting lifeline assembly comprises a housing, a brake hub, a first lifeline assembly, a first centrifugal clutch assembly, a second lifeline assembly, and a second centrifugal clutch assembly. The housing defines a cavity having a first portion, a second portion, and an intermediate portion interconnecting the first portion and the second portion. The brake hub is configured and arranged to be housed within the intermediate portion and includes teeth on opposing sides proximate the first portion and the second portion. The first lifeline assembly is configured and arranged to be housed within the first portion, and a first lifeline is wound about the first lifeline assembly. The first lifeline assembly rotates within the housing to pay-out the first lifeline. The first centrifugal clutch assembly includes a first pawl operatively connected to the first lifeline assembly. The second lifeline assembly is configured and arranged to be housed within the second portion, and a second lifeline is wound about the second lifeline assembly. The second lifeline assembly rotates within the housing to pay-out the second lifeline. The second centrifugal clutch assembly includes a second pawl operatively connected to the second lifeline assembly. The first pawl is configured and arranged to engage at least one of the respective teeth of the brake hub to stop rotation of the first lifeline assembly when there is a sudden acceleration at which the first lifeline assembly turns to pay-out the first lifeline causing the first pawl to pivot and engage the at least one of the respective teeth thereby preventing additional pay-out of the first lifeline. The second pawl is configured and arranged to engage at least one of the respective teeth of the brake hub to stop rotation of the second lifeline assembly when there is a sudden acceleration at which the second lifeline assembly turns to pay-out the second lifeline causing the second pawl to pivot and engage the at least one of the respective teeth thereby preventing additional pay-out of the second lifeline.

In another aspect of the invention, a self-retracting lifeline assembly for use with a safety harness includes shoulder straps routed through slots in a dorsal pad assembly forming a gap between the shoulder straps and the dorsal pad assembly. A housing has a cavity, a top portion, and a bottom portion. A self-retracting lifeline assembly is positioned within the cavity and includes a lifeline with at least a portion of the lifeline extending out of the top portion of the housing. A connector is operatively connected to the bottom portion of the housing. The connector includes a structural member having a secured position and a connecting position. The structural member is configured and arranged to be inserted through the gap between the shoulder straps and the dorsal pad assembly in the connecting position and then positioned in the secured position to releasably connect the bottom portion of the housing to the safety harness. A connecting strap is operatively connected to the top portion of the housing. The connecting strap has a first portion and a second portion. The first portion is releasably connectable to the second portion. At least one of the first and second portions is configured and arranged to be routed about the shoulder straps proximate above the dorsal pad assembly to releasably connect the top portion of the housing to the safety harness.

Another aspect of the invention provides for a method of connecting a safety device to a safety harness. The safety harness has shoulder straps routed through slots in a dorsal pad assembly forming a gap between the shoulder straps and the dorsal pad assembly. A connector is connected to a housing of safety device. The connector includes a structural member having a secured position and a connecting position. The structural member is configured and arranged to be inserted through the gap between the shoulder straps and the dorsal pad assembly in the connecting position and then positioned in the secured position to releasably connect the housing to the safety harness. A connecting strap is connected to the housing of the safety device. The connecting strap has a first portion and a second portion. The first portion is releasably connectable to the second portion. At least one of the first and second portions is configured and an arranged to be routed about the shoulder straps proximate the dorsal pad assembly to releasably connect the housing to the safety harness. The structural member is positioned in the connecting position, inserted through the gap between the shoulder straps and the dorsal pad assembly, and then positioned in the secured position, At least one of the first and second portions of the connecting strap is routed about the shoulder straps proximate the dorsal pad assembly and then the first and second portions of the connecting strap are connected.

BRIEF DESCRIPTION OF THE DRAWINGS

FIG. 1 is a rear view of a self-retracting lifeline constructed according to the principles of the present invention;

FIG. 2 is a top view of the self-retracting lifeline shown in FIG. 1;

FIG. 21 is a cross-section view taken along the lines 21-21 of the self-retracting lifeline shown in FIG. 20;

FIG. 22 is a cross-section view taken along the lines 22-22 of the self-retracting lifeline shown in FIG. 20;

DETAILED DESCRIPTION OF A PREFERRED EMBODIMENT

Figure 3:
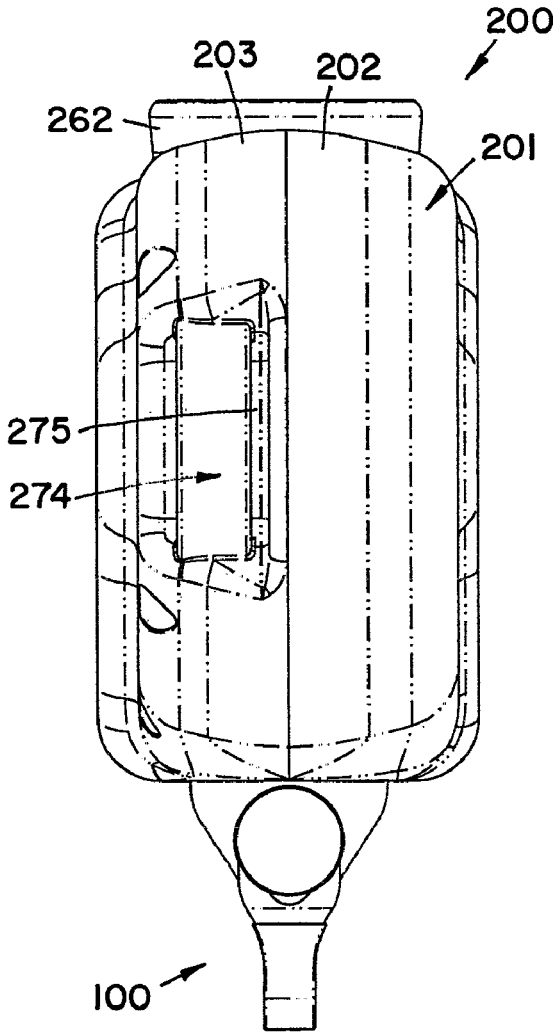
FIG. 3 is a side view of the self-retracting lifeline shown in FIG. 1.

Self-retracting lifeline assemblies constructed according to the principles of the present invention are designated by the numeral 200 and by the numeral 400 in the drawings.

The self-retracting lifeline is similar to that disclosed in U.S. patent application Ser. No. 10/914,631, which is incorporated by reference herein, but includes other features as will be described herein.

The self-retracting lifeline 200 includes a housing 201, which is preferably kidney-shaped with a front portion 202, a rear portion 203, and a cavity 204. The front portion 202 and the rear portion 203 enclose the cavity 204, in which there is a first portion 204*a* and a second portion 204*b* which are preferably circular-shaped to define the kidney-shaped housing 201. A first flange 206 and a second flange 208 extend outwardly from the bottom of the housing 201 and each flange includes an aperture (not shown) to enable the self-retracting lifeline 200 to be connected to a support structure (not shown) by a connector 100 or other suitable connecting device well known in the art.

Around the perimeter of the front portion 202 of the housing 201, extending longitudinally therethrough, are preferably four bores 210 about each portion 204*a* and 204*b* configured and arranged to engage fasteners 212. The rear portion 203 includes bores (not shown) in alignment with the bores 210 through which the fasteners 212 extend thus connecting the front portion 202 and the rear portion 203. The perimeter of the front portion 202 also includes preferably three bores 211 extending longitudinally therethrough proximate the juncture of the first portion 204*a* and the second portion 204*b*, between the two sets of four bores 210, with two bores 211 proximate the top and one bore 211 proximate the bottom.

Figure 15:
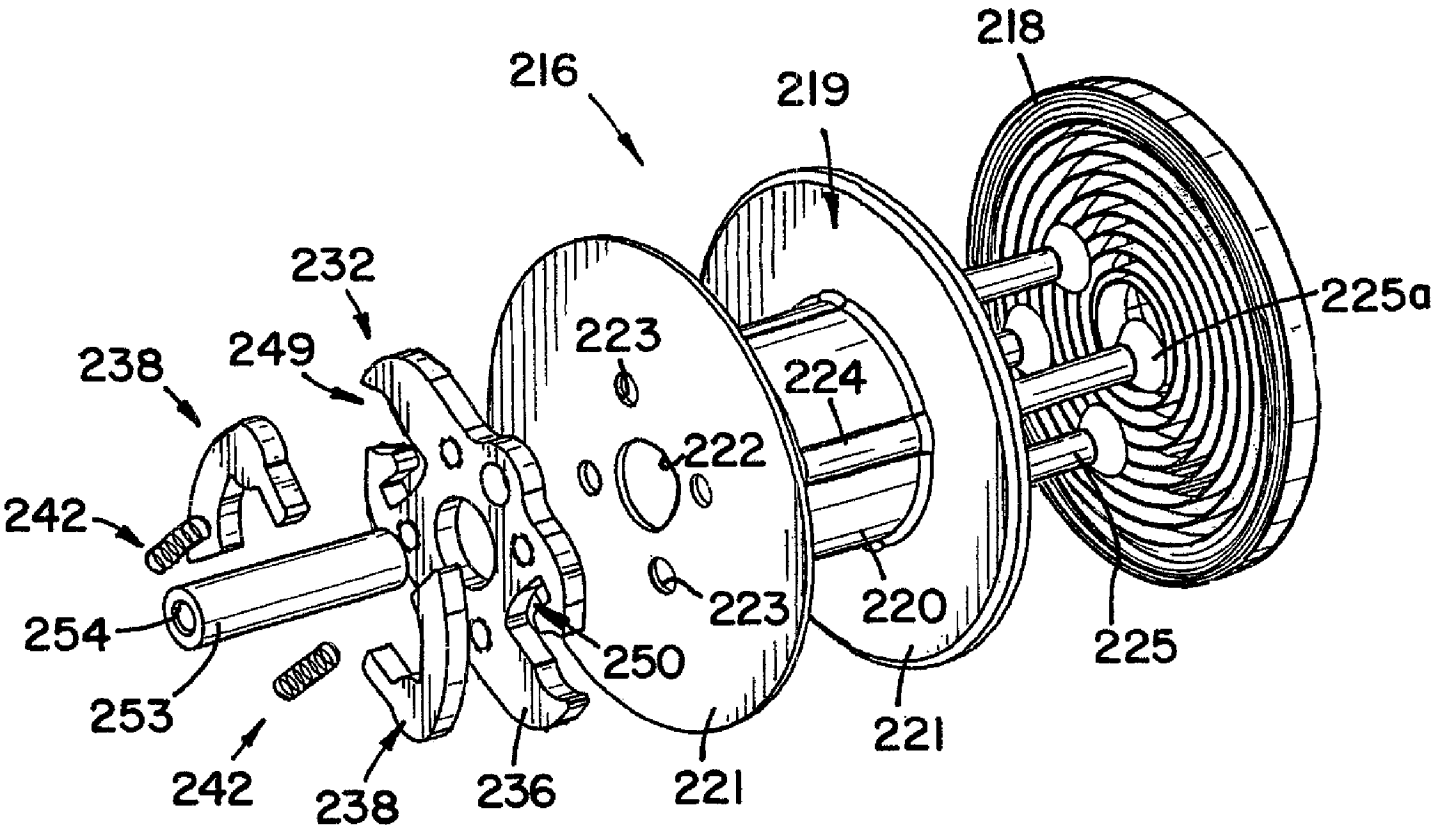
FIG. 15 is an exploded perspective view of components of the brake assembly shown in FIG. 5.
Figure 16:
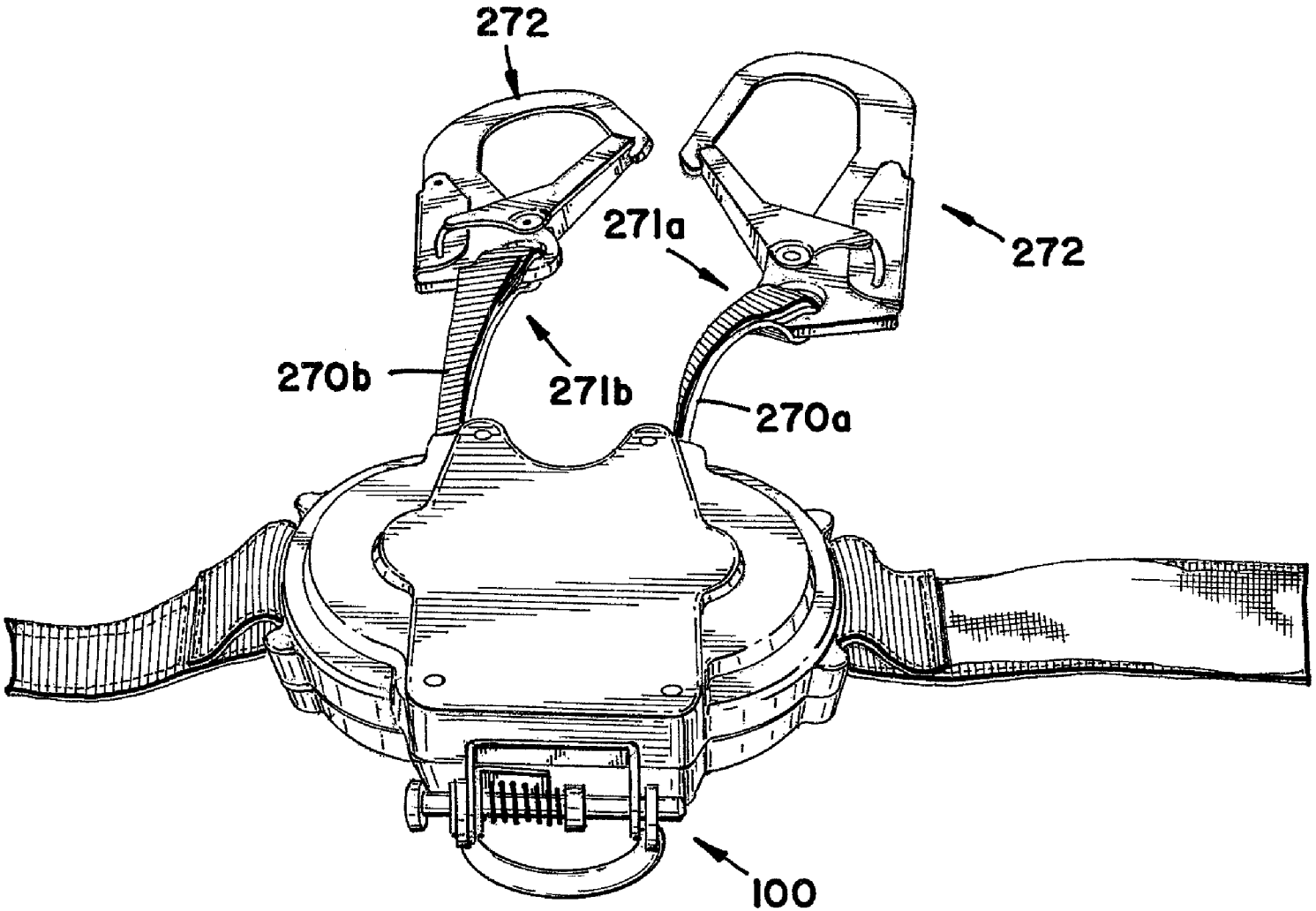
FIG. 16 is a perspective view of a self-retracting lifeline constructed according to the principles of the present invention.

A first cable assembly 214 fits within the first portion 204*a* and a second cable assembly 216 fits within the second portion 204*b*. The first cable assembly 214 and the second cable assembly 216 are preferably identical with the main difference being that they are counter-rotating within the housing 201. Therefore, only the second cable assembly 216 will be described. The second cable assembly 216 is shown in FIG. 15.

Within the second portion 204*b* proximate the front portion 202 is a spring 218, which is preferably a spiral motor spring with an inner end (not shown) and an outer end (not shown). The inner end is operatively connected to a drum 219, and the outer end is operatively connected to the front portion 202. The drum 219 resembles a spool and includes a cylinder portion 220 and a rim 221 on each end of the cylinder portion 220. A bore 222 extends longitudinally through the center of the cylinder portion 220, and four bores 223 extend longitudinally through the cylinder portion 220 about the bore 222. The bores 223 form ribs 224 along the cylinder portion 220. The bores 223 are preferably countersunk on one side (not shown) and are configured and arranged to engage bolts 225 with heads 225*a*. The heads 225*a* fit within the countersunk portions of the bores 223 so as to not interfere with operation of the self-retracting lifeline 200. The rim 221 facing the front portion 202 includes a boss (not shown), which extends outward around the bore 222. The boss includes a slot (not shown) therein. The drum 219 is also configured and arranged to fit within the second portion 204*b*.

A brake assembly 230 includes a brake hub 231 and a centrifugal clutch assembly 232. The brake hub 231 is generally I-shaped and is operatively connected to the front portion 202 proximate the juncture of the first portion 204*a* and the second portion 204*b*. Preferably three ratcheting catches or teeth 234 extend outward from each side of the brake hub 231 into the first and second portions 204*a* and 204*b*, respectively. The brake hub 231 includes apertures 229, preferably two apertures 229 proximate the top and one aperture 229 proximate the bottom. The apertures 229 are in alignment with the bores 211 in the front portion 202.

The centrifugal clutch assembly 232 includes a plate 236, pawls 238, and springs 242. The plate 236 is generally an oval-shaped disk including a finger portion 245 and a hook portion 246 at opposing ends. An aperture 237 proximate the center of the plate 236 is in alignment with bore 222, and apertures 247 are arranged about aperture 237 in alignment with bores 223. The aperture 237 and the apertures 247 form a central, generally circular portion 248 of the plate 236. The finger portions 245 and the hook portions 246 extend from the central portion 248 of the plate 236 to form the generally oval-shaped disk. Between the finger portions 245 and the hook portions 246 are inlet portions 249, which include expanded inlet portions 250. The finger portions 245 extend outward proximate one side of each end, and the hook portions 246 extend outward and then inward toward the finger portions 245 proximate the opposite side of each end. The finger portions 245 extend outward to the end of the plate 236, but the hook portions 246 do not extend outward to the end of the plate 236. The hook portions 246 extend outward approximately half the distance of the finger portions 245 before they extend inward toward the finger portions 245. Each end is basically a mirror image of the other end so the finger portions 245 are diagonal from one another and the hook portions 246 are diagonal from one another.

The inlet portions 249 and the expanded inlet portions 250 are notches in the plate 236 between the finger portions 245 and the hook portions 246. The inlet portions 249 are approximately ½ to ⅓ the width of the plate 236 and extend from proximate the middle of each end to proximate midway to the aperture 237. The expanded inlet portions 250 extend from the end of the inlet portions 249 proximate midway to the aperture 237 inward toward the hook portions 246. In other words, the inlet portions 249 and the expanded inlet portions 250 coordinate to define the shapes of the finger portions 245 and the hook portions 246 and to form notches within which the springs 242 and portions the pawls 238 are arranged.

Figure 5:
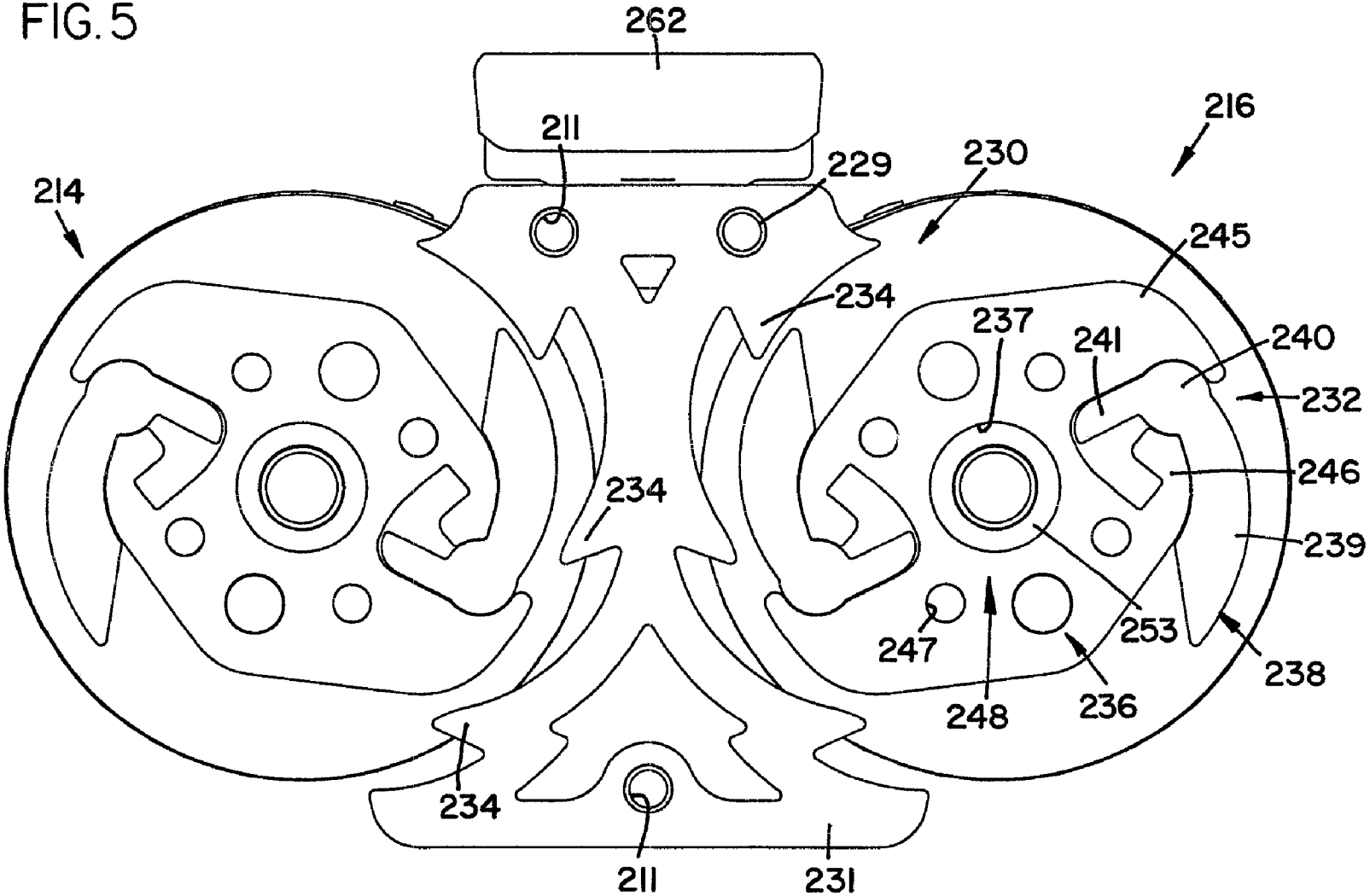
FIG. 5 is a rear view of a brake assembly of the self-retracting lifeline shown in FIG. 1.
Figure 9:
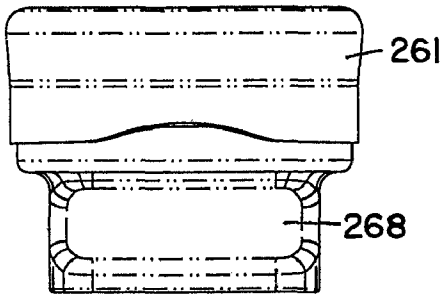
FIG. 9 is another side view with contour lines of the cable guide shown in FIG. 6.
Figure 6:
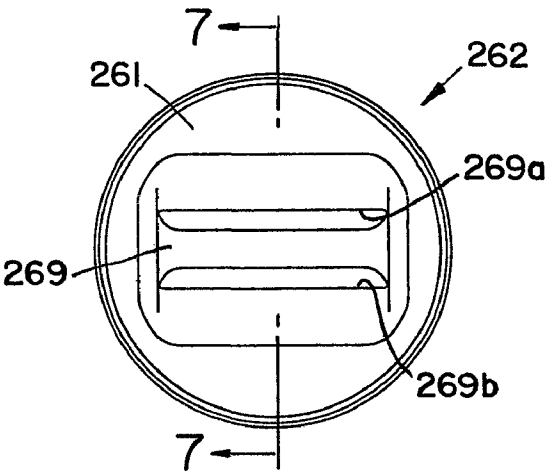
FIG. 6 is a top view of a cable guide of the self-retracting lifeline shown in FIG. 1.
Figure 8:
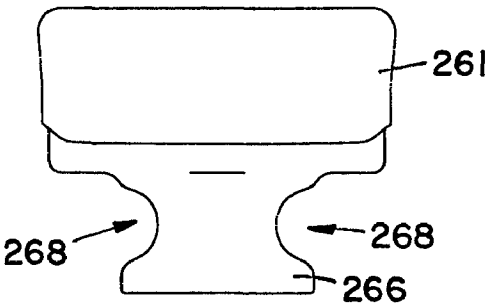
FIG. 8 is a side view of the cable guide shown in FIG. 6.
Figure 7:
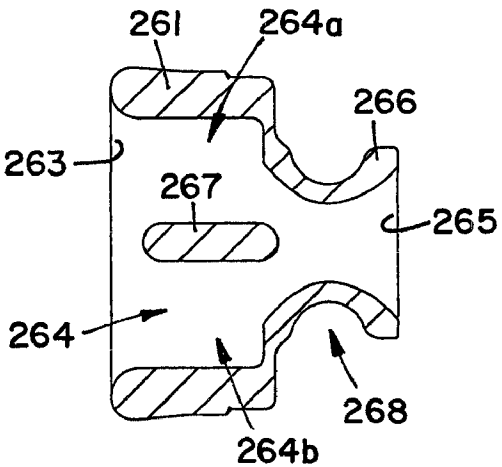
FIG. 7 is a cross-section view taken along the lines 7-7 of the cable guide shown in FIG. 6.

The pawls 238 each include a base portion 239, an intermediate portion 240, and an extension portion 241. The intermediate portion 240 is generally circular in shape, and the base portion 239 extends from one side and the extension portion 241 extends from another, generally opposite side of the intermediate portion 240. The base portion 239 is preferably curved to form an arc-shape. As shown in FIGS. 5 and 15, the intermediate portion 240 and the base portion 239 resemble a mirror image of a comma. The extension portion 241 is generally rectangular and extends generally 90° from the base portion 239.

The inlet portion 249 is configured and arranged to receive the intermediate portion 240, which may pivot therein. The extension portion 241 extends into the expanded inlet portion 250, and the base portion 239 extends outward from the inlet portion 249. The arc-shape of the base portion 239 coordinates with the finger portion 245 and the hook portion 246. The top of the arc-shape of the base portion 239 follows the line of the curvature of the end of the finger portion 245 (and the end of the plate 236), and the bottom of the arc-shape follows the curvature of the hook portion 246. The top of the arc-shape is like an extension of the finger portion 245, and the bottom of the arc-shape fits around the hook portion 246. Springs 242 are configured and arranged to fit within the expanded inlet portions 250 between the hook portions 246 and the extension portions 241. In a first position, the spring 242 provides a constant force upon the extension portion 241 thereby pushing the extension portion 241 against the finger portion 245 and the base portion 239 against the hook portion 246. The first position is shown in FIG. 5. In a second position, the force of the spring 242 is overcome by the extension portion 241 to compress the spring 242 thereby pivoting the pawl 238 so that the extension portion 241 moves toward the hook portion 246 and the base portion 239 moves away from the hook portion 246. The first position allows the pawl 238 to bypass the ratcheting teeth 234 of the brake hub 231 while the second position allows the pawl 238 to engage the ratcheting teeth 234 of the brake hub 231.

A shaft 253 having a longitudinal bore 254 is configured and arranged to fit within and through aperture 237 and bore 222 proximate the inner end of the spring 218. The inner end of the spring 218 is inserted into the slot of the boss in rim 221 and is operatively connected thereto. The boss is larger in diameter than the shaft 253 and is preferably as thick as the spring 218. The outer end of the spring 218 is operatively connected to the inner surface of the front portion 202 by means well known in the art, The spring 218 coils more or less tightly in response to rotation of the drum 219 as the cable is unwound from and wound about the drum 219. The spring 218 maintains a continuous turning force on the drum 219 so that the cable is continuously urged to be wound about the drum 219.

A plate member 258 includes apertures (not shown), which are in alignment with the apertures 229 of the brake hub 231 and the bores 211 of the front portion 202. Fasteners 259 are inserted through the apertures and the apertures 229 and secured within the bores 211 to connect the plate member 258 and the brake hub 231 to the front portion 202. The plate member 258, the plate 236, and the rim 221 hold the pawls 238 and the springs 242 in place within the inlet portion 249 and the expanded inlet portion 250 without any fasteners or connecting devices securing the pawls 238 and the springs 242. The plate member 258 also secures the cable assemblies 214 and 216 within the cavity 204 of the front portion 202. Further, the plate member 258 is operatively connected to the flanges 206 and 208, which are preferably integral with the plate member 258.

As shown in FIGS. 6-9, a cable guide 262 includes a cylindrical base 261 having an elongate aperture 263 proximate the top and an inlet portion 266 having an aperture 265 proximate the bottom allowing access into a cavity 264 in fluid communication with the apertures 263 and 265. The base 261 includes a spacer 267 proximate the aperture 263 which separates the cavity 264 into two portions 264*a* and 264*b*. The inlet portion 266 includes opposing curved surfaces 268 curving inward toward one another and narrowing the cavity 264 proximate the middle of the inlet portion 266. A cap 269 is a rectangular disk having two elongate slots 269*a* and 269*b*. The cap 269 is configured and arranged to cover the opening 263.

The self-retracting lifeline 200 is configured and arranged to allow each of the cables 270*a* and 270*b* to extend upward from each of the respective drums 219 out of the housing 201 through the cable guide 262. Thus, the cables extend out of the housing 201 in an upward orientation with respect to the self-retracting lifeline 200. One of the cables extends through the aperture 265, through the portion 264*a*, through the aperture 263, and through the slot 269*a*. The other cable extends through the aperture 265, through the portion 264*b*, through the aperture 263, and through the slot 269*b*. The curved surfaces 268 assist in guiding the cables into their respective portions 264*a* and 264*b* and prevent wear on the cables, and the spacer 267 and the slots 269*a* and 269*b* assist in keeping the cable apart.

Each of the cables 270*a* and 270*b* includes a first end (not shown), a second end 271*a* and 271*b* to which hooks 272 may be connected, and an intermediate portion therebetween (not shown). Although the term cable is used herein, it is recognized that webbing, rope, or other suitable lifeline may be used. The cables serve as the lifelines of the self-retracting lifeline 200. For each cable assembly 214 and 216, the intermediate portion is wound onto and off of the cylinder portion 220 of the drum 219, and the rims 221 on either side of the cylinder portion 220 keep the cable on the cylinder portion 220, The first end of the cable is fixedly operatively connected by means well known in the art to the drum 219. For example, one such way is shown and described in U.S. Pat. No. 5,186,289, which is incorporated by reference herein. The second end of the cable extends through the housing 201 and is operatively connected to a fastening device (not shown) such as a snap hook. The second ends 270*a* and 270*b* of the cables are shown in FIG. 10 extending out of the housing 201.

Figure 11:
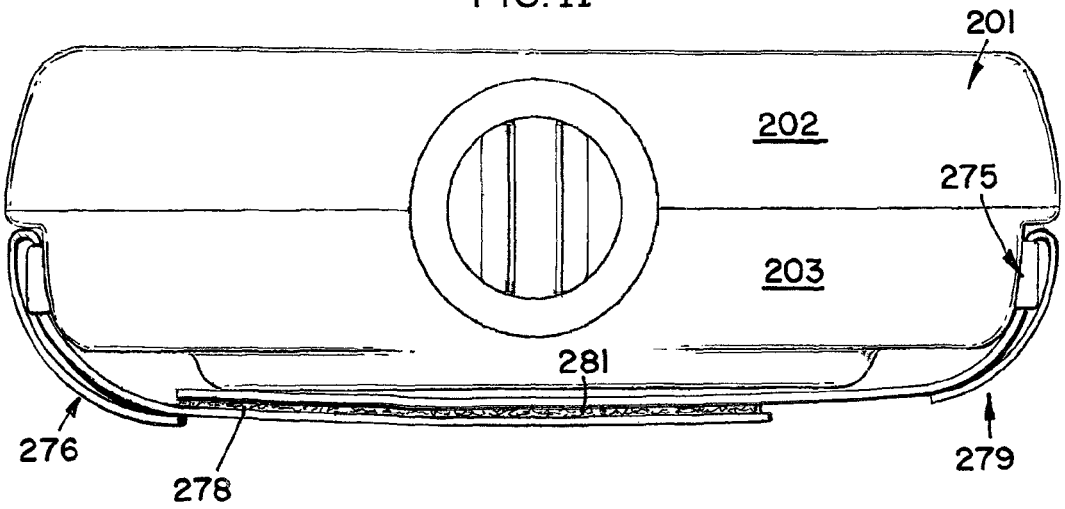
FIG. 11 is a top view of the self-retracting lifeline shown in FIG. 1 with the securing straps shown in FIG. 10.
Figure 10:
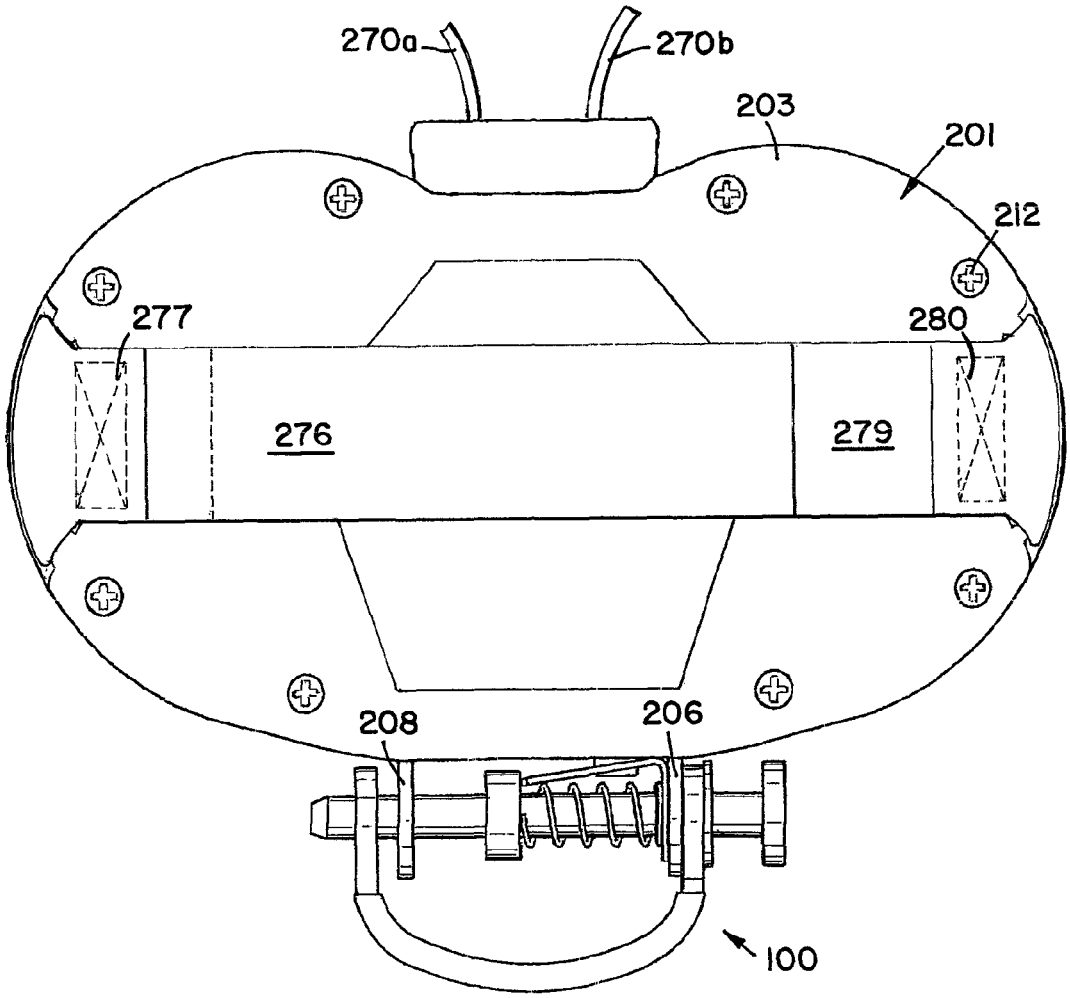
FIG. 10 is a rear view of the self-retracting lifeline shown in FIG. 1 with securing straps.
Figure 12:
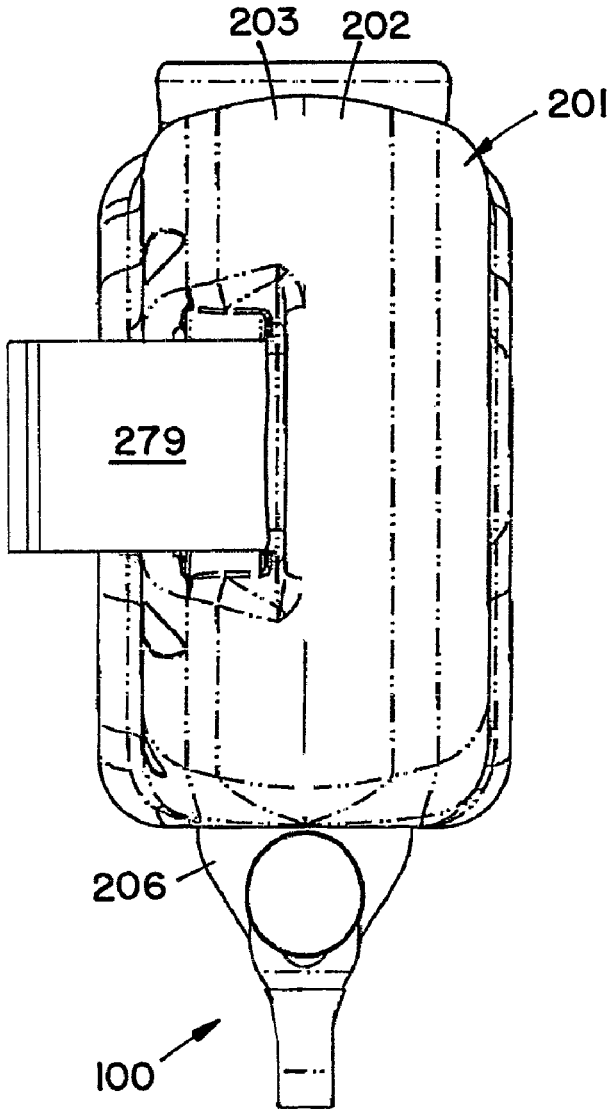
FIG. 12 is a side view of the self-retracting lifeline shown in FIG. 1 with the securing straps shown in FIG. 10.
Figure 17:
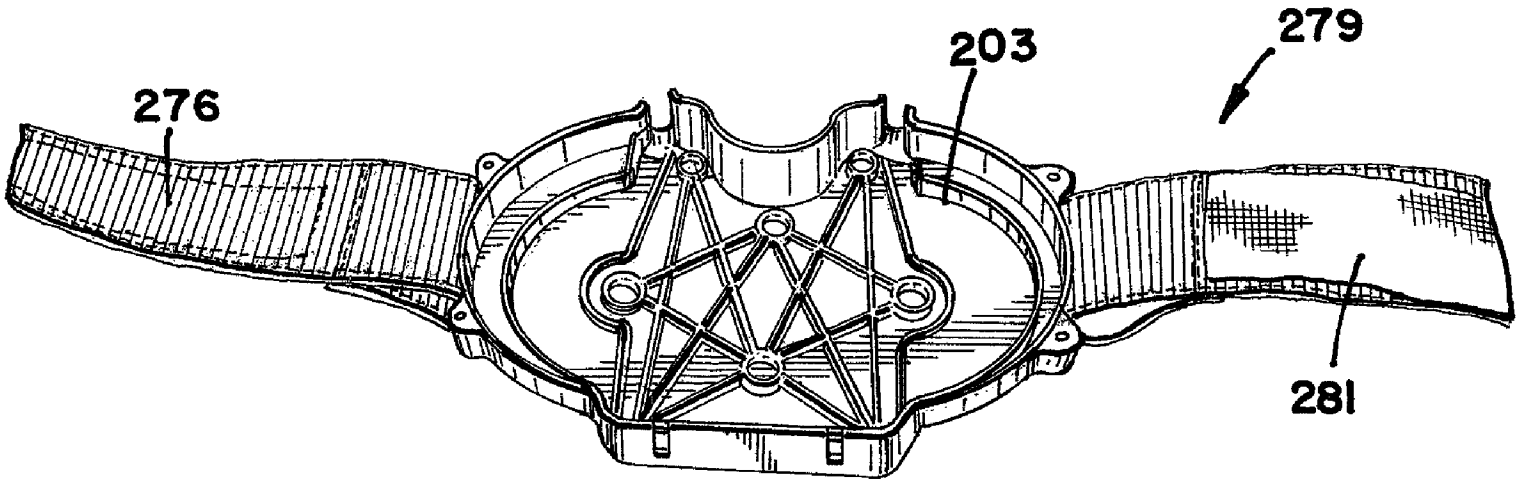
FIG. 17 is a perspective view of a rear portion of a housing of the self-retracting lifeline shown in FIG. 16.
Figure 18:
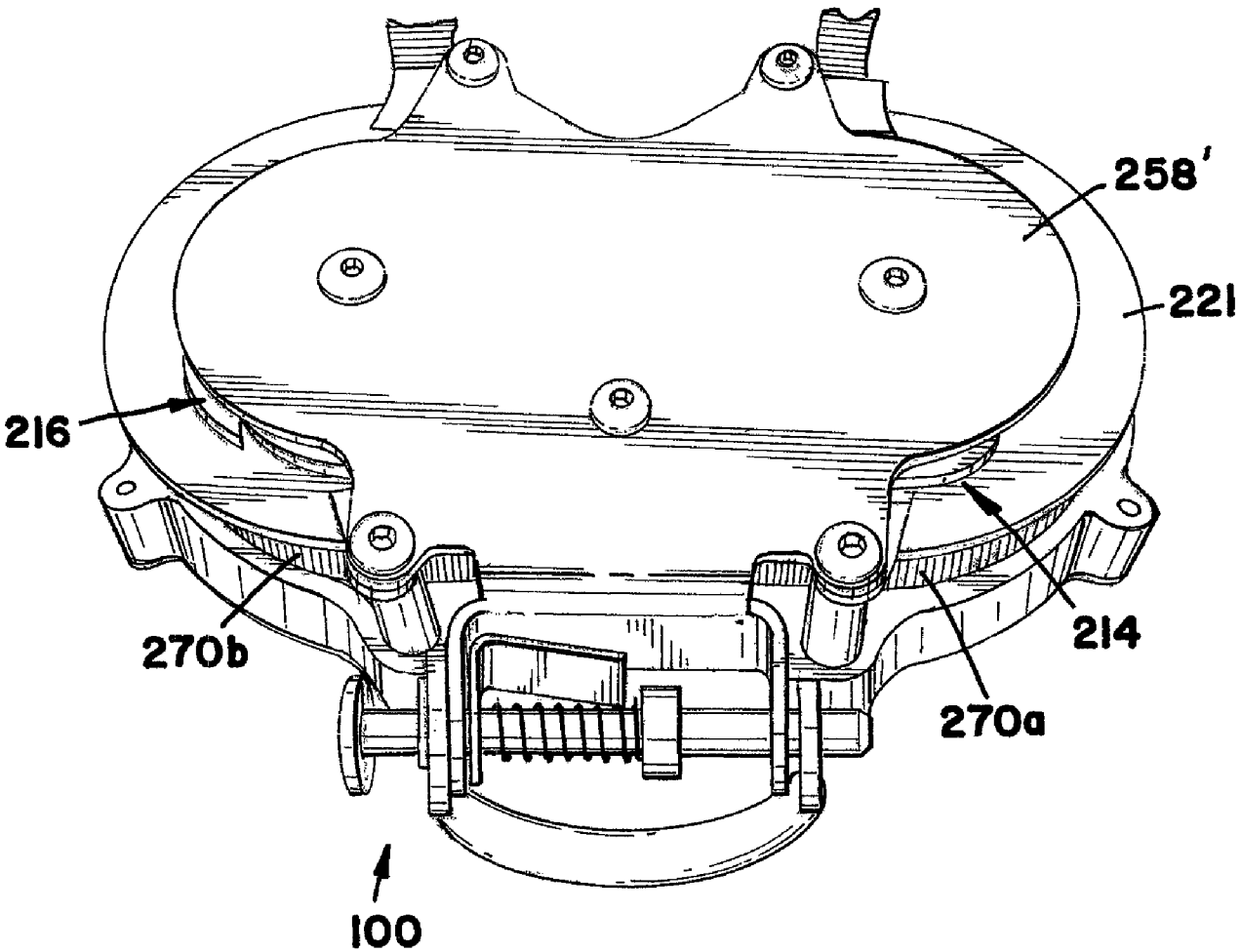
FIG. 18 is a perspective view of the self-retracting lifeline shown in FIG. 16 with the rear portion of the housing removed.

Optionally, as shown in FIGS. 10-12, the back portion 203 may include a bar portion 275 and a slot 274 between the back portion 203 and the bar portion 275 proximate each side. A first strap 276, preferably made of webbing, is threaded through one of the slots 274 and folded back onto itself about the bar portion 275 and secured thereto with stitching 277. The side of the first strap 276 facing the back portion 203 includes a fastener 278 such as a hook material. A second strap 279, also preferably made of webbing, is threaded through the other slot 274 and folded back onto itself about the bar portion 275 and secured thereto with stitching 280. The side of the second strap 279 facing away from the back portion 203 includes a fastener 281 such as a loop material. The fasteners 278 and 281 are releasably secured to one another. FIG. 17 shows the fasteners connected to opposite sides of the straps and the straps are releasably connected to one another via their opposite sides.

Figure 4:
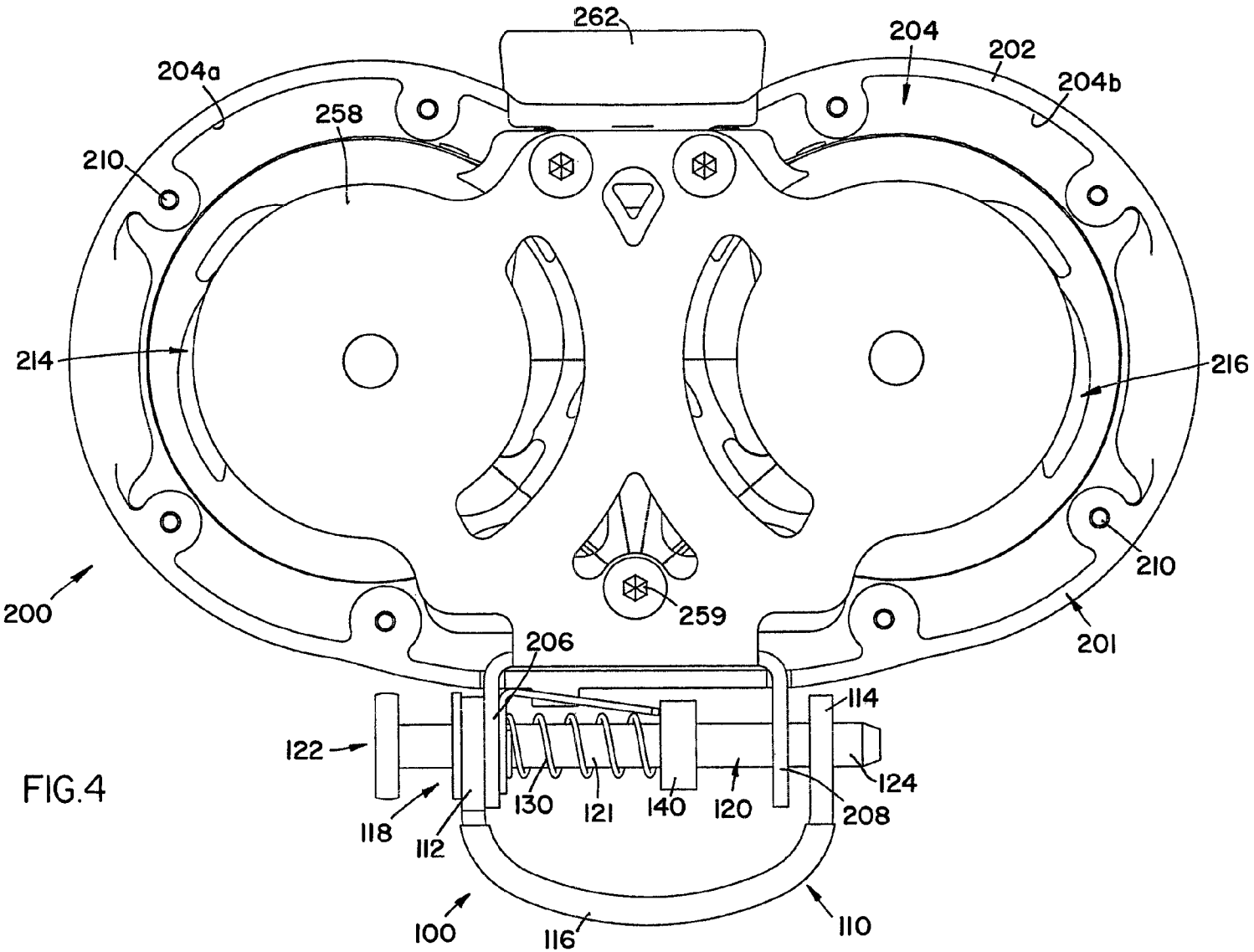
FIG. 4 is a rear view of the self-retracting lifeline shown in FIG. 1 with a rear portion removed.

The self-retracting lifeline 200 is operatively connected to a safety harness donned by a worker, and at least one of the cables is operatively connected to a support structure. A connector may be used to connect the self-retracting lifeline 200 to the safety harness. A suitable connector 100 that may be used with the present invention is described in U.S. Pat. No. 6,073,724, which is incorporated herein by reference. Those skilled in the art will recognize that other suitable connectors may be used. With reference to FIG. 4, the connector 100 includes a structural member 110 and a bolt 120 which cooperate to releasably connect the self-retracting lifeline 200 to the safety harness. The connector 100 releasably connects the self-retracting lifeline 200 to the safety harness, and the cables releasably connect the self-retracting lifeline 200 to the support structure.

The structural member 110 is preferably made of steel and may be described as a U-shaped member having an intermediate base portion and opposite legs or ends 112 and 114 which extend from opposite ends of the base portion and parallel to one another. The base portion is covered by a protective sleeve 116 which is preferably made of plastic. A slot 118 is provided in the first end 112 of the member 110, and a threaded hole (not shown) is provided in the second end 114 of the member 110.

The bolt 120 is preferably made of steel and has a shaft 121 which extends perpendicular to the ends 112 and 114 of the member 110. A first end 122 of the bolt 120 is provided with a head having a diameter which is greater than the diameter of the shaft 121. A second, opposite end 124 of the bolt 120 is provided with external helical threads which mate with the threaded hole in the second end 114 of the member 110.

The second end 124 of the bolt 120 is inserted through the slot 118, then through a hole in the first flange 206 of the self-retracting lifeline 200, and then through a helical coil spring 130. A stop 140 is then rigidly secured to an intermediate portion of the shaft 121 on the bolt 120, in such a manner that the spring 130 is compressed between the stop 140 and the first flange 206. The stop 140 has a relatively larger diameter than the shaft 121 of the bolt 120 and may be described as a shoulder on the bolt 120. The second end 124 may then be selectively inserted through a hole in a second flange 208 of the self-retracting lifeline 200, and threaded through the hole in the second end 114 of the member 110.

The threads (not shown) on the second end 124 of the bolt 120 and inside the hole in the second end 114 of the member 110 provide a means for selectively connecting the second end 124 of the bolt 120 to the second end 114 of the member 110. The spring 130 cooperates with the stop 140 to provide a means for biasing the second end 124 of the bolt 120 to remain connected to the second end 114 of the member 110. The stop 140, the first end 112 of the member 110, and the head of the bolt 120 cooperate to provide a means for securing the connector 100 to the first flange 206. The slot 118 in the first end 112 of the member 110 provides a means for pivoting the connector 100 relative to the first flange 206 when the second end 122 of the bolt is free of the second flange 208.

Figure 13:
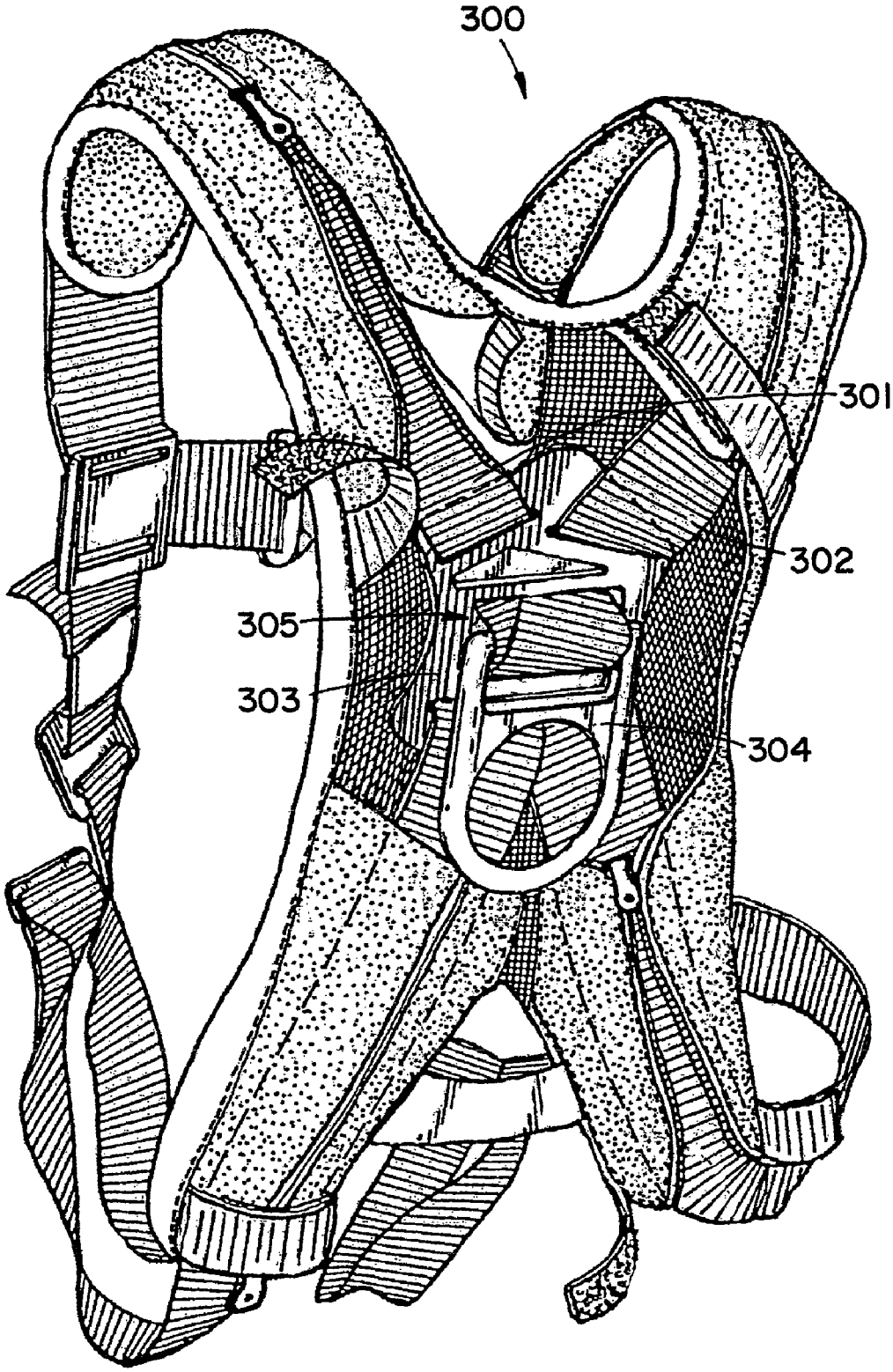
FIG. 13 is a perspective view of a safety harness that may be used with the self-retracting lifeline shown in FIG. 1.
Figure 14:
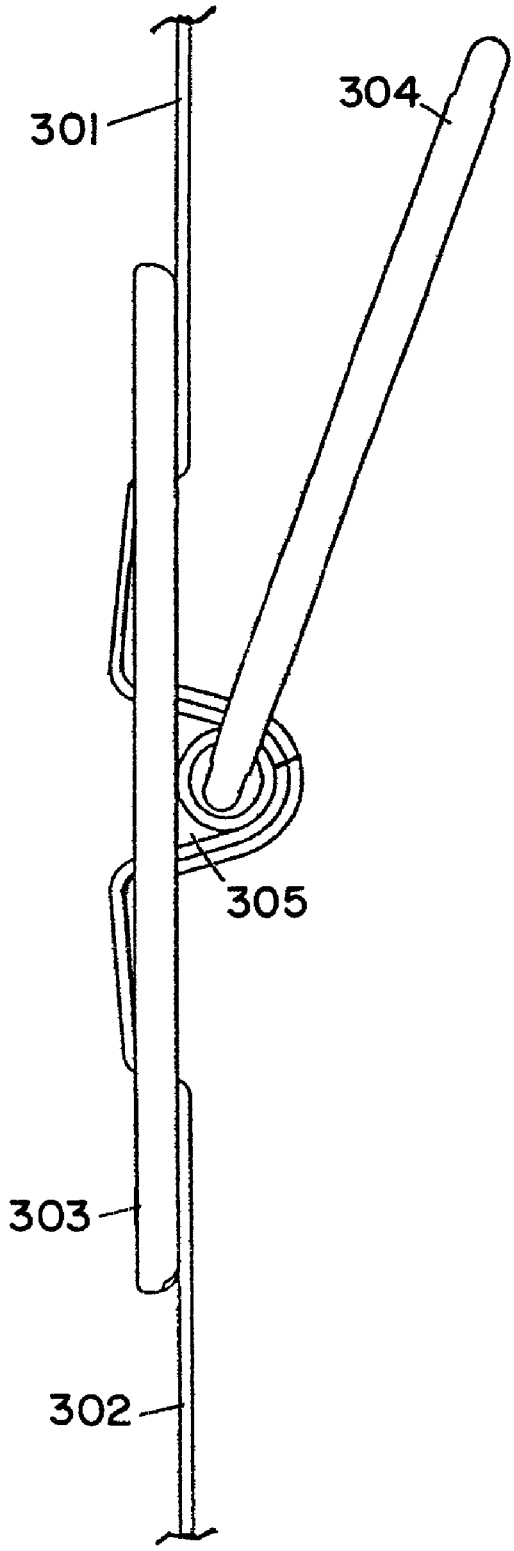
FIG. 14 is a side view of a dorsal pad assembly of a safety harness that may be used with the self-retracting lifeline shown in FIG. 1.

The connector 100 may be releasably connected to a safety harness 300 proximate a dorsal pad assembly. Although many different types of safety harnesses may be used, an example of a suitable safety harness 300 is shown in FIG. 13. The safety harness 300 includes a first strap 301 and a second strap 302 that are threaded through a dorsal pad 303 and criss-cross in a divergent fashion as is known in the art. A D-ring 304 is secured between the straps 301 and 302 and the dorsal pad 303 proximate the juncture of the strap 301 and 302. A gap 305 is created between the dorsal pad 303 and the straps 301 and 302 proximate the D-ring 304, as shown in FIG. 14. The connector 100 is opened, the structural member 110 is inserted through the gap 305, and then the connector 100 is secured thus connecting the connector to the safety harness 300.

Additionally, the self-retracting lifeline 200 may also be connected to the safety harness 300 with the straps 276 and 279. The straps 276 and 279 are released from one another in a receiving position and placed about the respective straps 301 and 302 of the safety harness 300 above the dorsal pad 303. The straps 276 and 279 are then releasably secured to one another in a securing position so that they extend between the straps 301 and 302 of the safety harness 300 and the worker's back, which is the opposite side of the safety harness 300 to which the connector 100 is connected. Thus, the bottom of the self-retracting lifeline 200 is connected to the safety harness 300 by inserting the structural member 110 through the gap 305 and securing the connector 100 thereto, and the top of the self-retracting lifeline 200 is connected to the safety harness 300 by placing the straps 276 and 279 about the straps 301 and 302 and releasably securing them together. Connecting the self-retracting lifeline 200 in this orientation allows for the cables to exit the top of the housing 201 and extend vertically upward for ease of use in applications where workers must connect to an overhead support structure.

Figure 26:
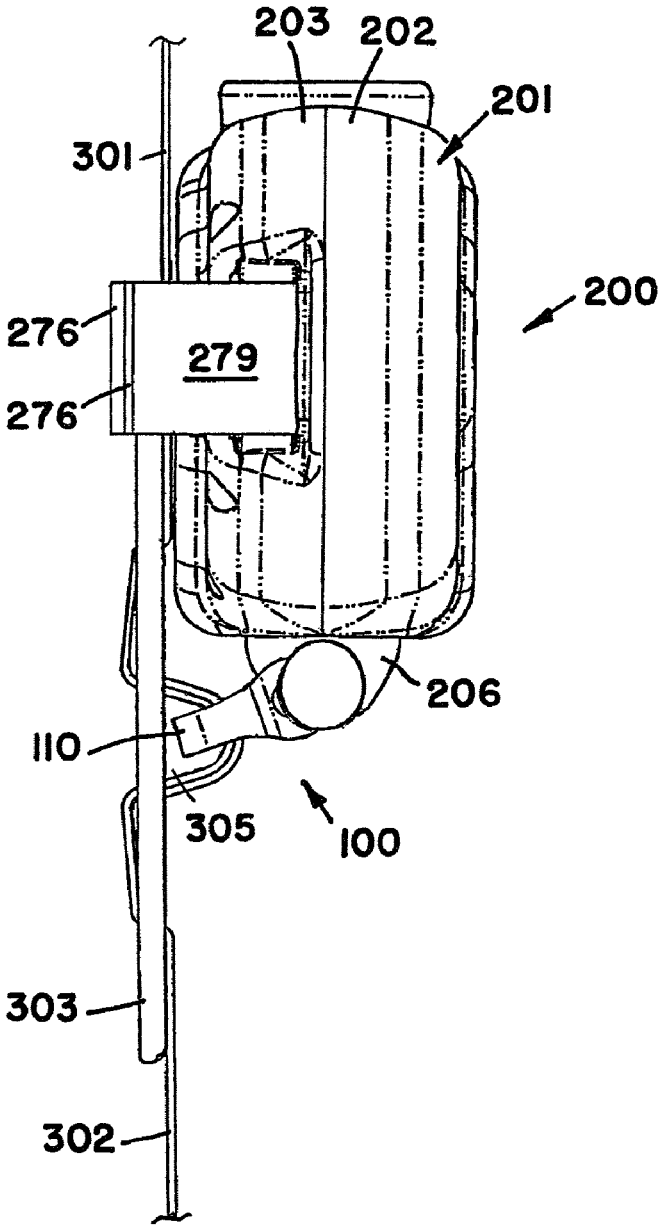
FIG. 26 is a side view of the self-retracting lifeline shown in FIG. 12 operatively connected to the dorsal pad assembly shown in FIG. 14.

FIG. 26 shows the self-retracting lifeline 200 operatively connected to the dorsal pad assembly shown in FIG. 14 with the D-ring 304 removed. The structural member 110 is inserted through the gap 305 and the connector 100 is secured. The straps 276 and 279 are positioned so that the straps 301 and 302 of the harness are between the housing 201 and the overlapping portions of the straps 276 and 279. The overlapping portions of the straps 276 and 279 are shown in FIG. 11 but in FIG. 26 the strap 279 blocks the view of the fasteners 278 and 281 that releasably connect the straps 276 and 279.

In operation, the worker is free to move about the vicinity of the self-retracting lifeline 200, with only the lengths of the cables restricting the distance of the worker's movement. The worker may alternate between securing one cable to a support structure and then disconnecting the other cable from a support structure to move about the vicinity. Thus, one cable is always secured to a support structure. As the worker moves further away from the self-retracting lifeline 200, cable is paid out of the device as it is unwound from the drum 219. As the worker moves closer to the self-retracting lifeline 200, cable is retracted into the device as it is wound about the drum 219. In the event a fall should occur, the sudden acceleration or high rate of speed at which the drum 219 turns to pay out cable causes the pawls 238 to overcome the force of the springs 242. The centrifugal force causes the pawls 238 to pivot away from the central portion 248 of the plate 236. The intermediate portion 240 rotates within the inlet portion 249, causing the extension portion 241 to pivot and compress the spring 242 and the base portion 239 to pivot away from the plate 236 and engage at least one of the teeth 234 of the brake hub 231. Engagement of the brake hub 231 by the pawls 238 activates the braking action of the self-retracting lifeline 200. Because the pawls 238 engage the teeth 234 and can no longer rotate within cavity 204, the pawls 238 cause the plate 236, which is connected to the rim 221 of the drum 219, to stop thus stopping the drum 219 and preventing additional cable to be paid out of the housing 201. Once pawls 238 have engaged the teeth 234, they cannot be disengaged until the drum 219 begins to rotate backward to rewind the cable onto the cylinder portion 220. This braking action applies to both cable assemblies 214 and 216. The brake hub 231 is located between the cable assemblies 214 and 216 and is shared. The teeth 234 do not extend about the perimeters of the cable assemblies 214 and 216, but the two pawls 238 of each assembly 214 and 216 assist in stopping the drums 219 quickly.

Figure 19:
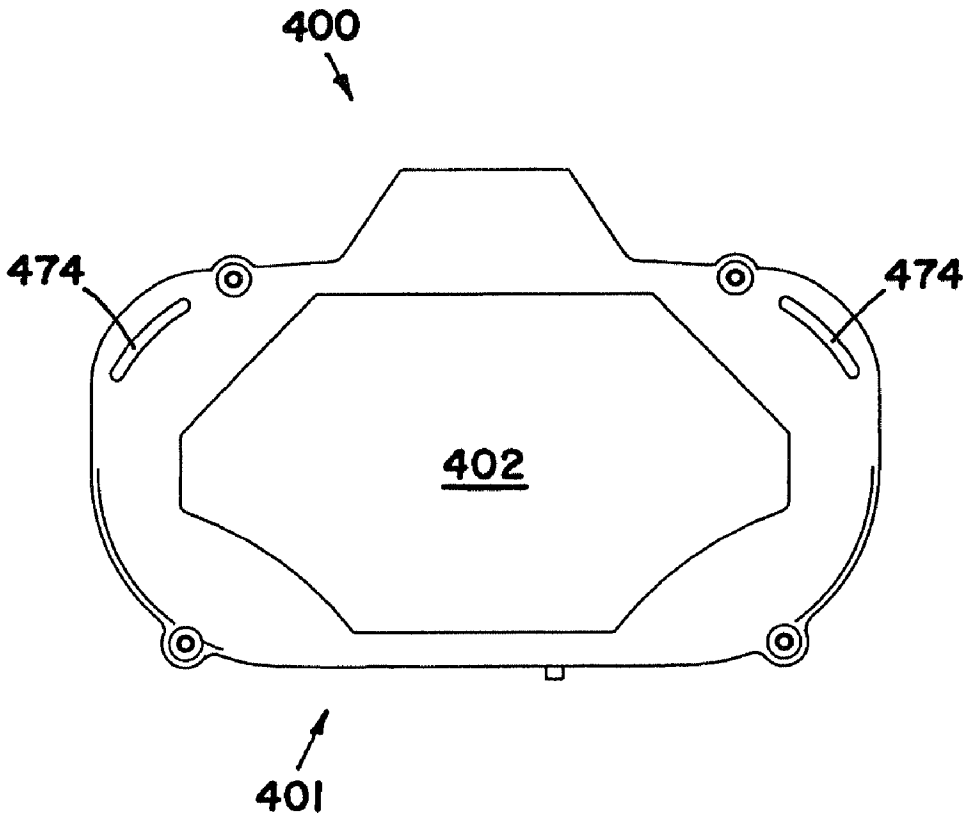
FIG. 19 is a front view of another embodiment self-retracting lifeline constructed according to the principles of the present invention.

It can be seen that the self-retracting lifeline 400 is similar to the self-retracting lifeline 200, and the following will be a description of components that include more substantive differences, The self-retracting lifeline 400 includes a housing 401 having a front portion 402 and a rear portion 403 that form a cavity 404 therebetween. The housing 401 is generally rectangular in shape to accommodate two cable assemblies positioned side-by-side within the cavity 404. The front portion 402 includes a slot 474 proximate each upper corner configured and arranged to receive a connecting strap (not shown) similar to the straps 276 and 279. The slots 474 are shown in FIG. 19.

Figure 20:
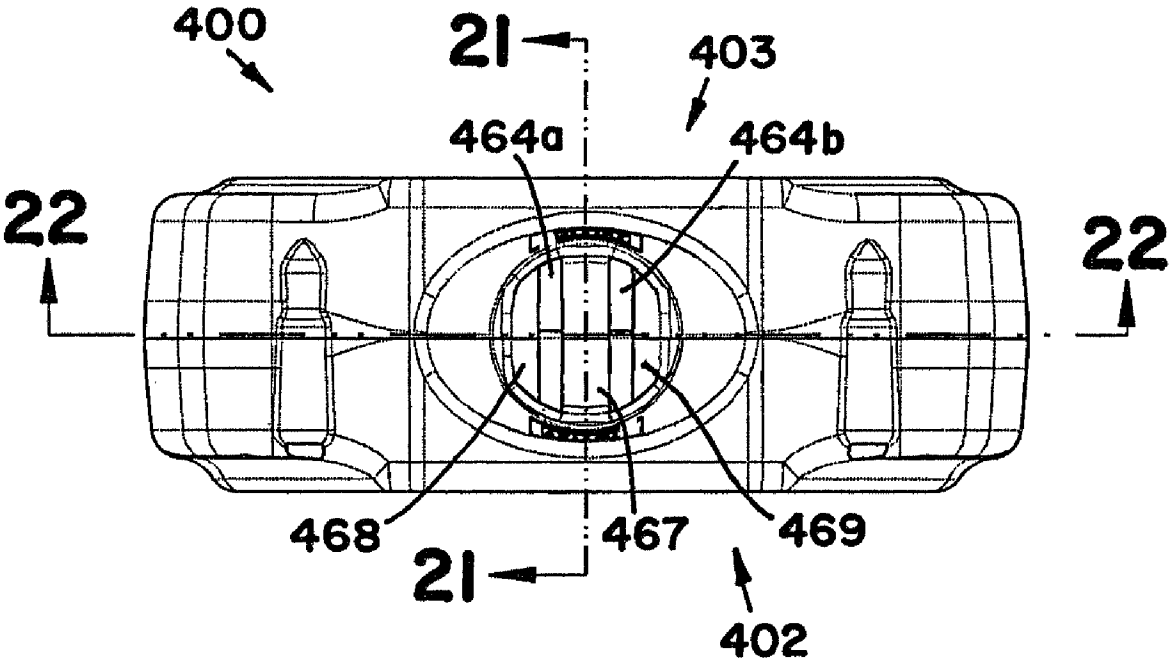
FIG. 20 is a top view of the self-retracting lifeline shown in FIG. 19.

The top of the housing 401 includes a cable guide 462, which is molded as an integral part of the front and rear portions 402 and 403, which when operatively connected form the cable guide 462. A top view of the housing 401 is shown in FIG. 20. As shown in FIG. 22, a first wall 468 and a second wall 469, which are extensions of the sides of the housing 401, are angled upward and inward and then extend downward and inward proximate the top of the housing 401. The walls 468 and 469 define a cavity 464, which includes an opening 463 from the cavity 464 out of the housing 401 and an opening 465 from the cavity 464 into the cavity 404. Thus, the cavity 404 is in fluid communication with the cavity 464 and out of the housing 401. A spacer 467, which is also an extension of the sides of the housing 401 as shown in FIG. 21, separates the cavity 464 into a first portion 464*a* and a second portion 464*b*. One of the cable assemblies is positioned within a first portion 404*a* of the cavity 404 and the cable extends through the first portion 464*a* and out of the housing 401. The other cable assembly is positioned within a second portion 404*b* of the cavity 404 and the cable extends through the second portion 464*b* and out of the housing 401 The spacer 467 separates the cables, which both extend out of the housing 401 through opening 463. The cable guide 462 assists in preventing the cables from getting tangled within the housing 401.

Figure 23:
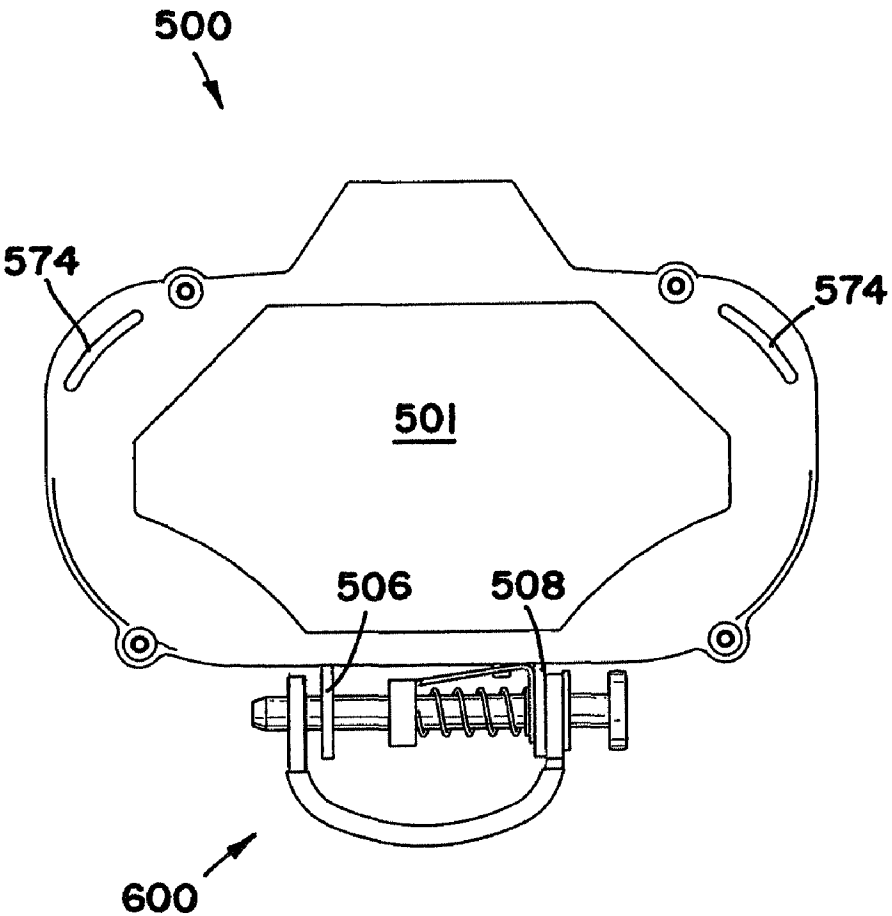
FIG. 23 is a front view of another embodiment self-retracting lifeline constructed according to the principles of the present invention.

Another embodiment self-retracting lifeline 500 is similar to the self-retracting lifeline 400 but includes a connector 600, which is similar to the connector 100, and is shown with first and second cable assemblies 514 and 516 configured and arranged to be housed within the cavity of the housing 501. The housing 501 includes a slot 574 proximate each upper corner configured and arranged to receive a connecting strap (not shown) similar to the straps 276 and 279. The slots 574 are shown in FIG. 23. A first flange 506 and a second flange 508 extend outwardly from the bottom of the housing 501 and each flange includes an aperture (not shown) to enable the self-retracting lifeline 400 to be connected to a support structure (not shown) by the connector 600 or other suitable connecting device well known in the art. The flanges 506 and 508 are operatively connected to a plate member 558 and extend downward therefrom.

Figure 24:
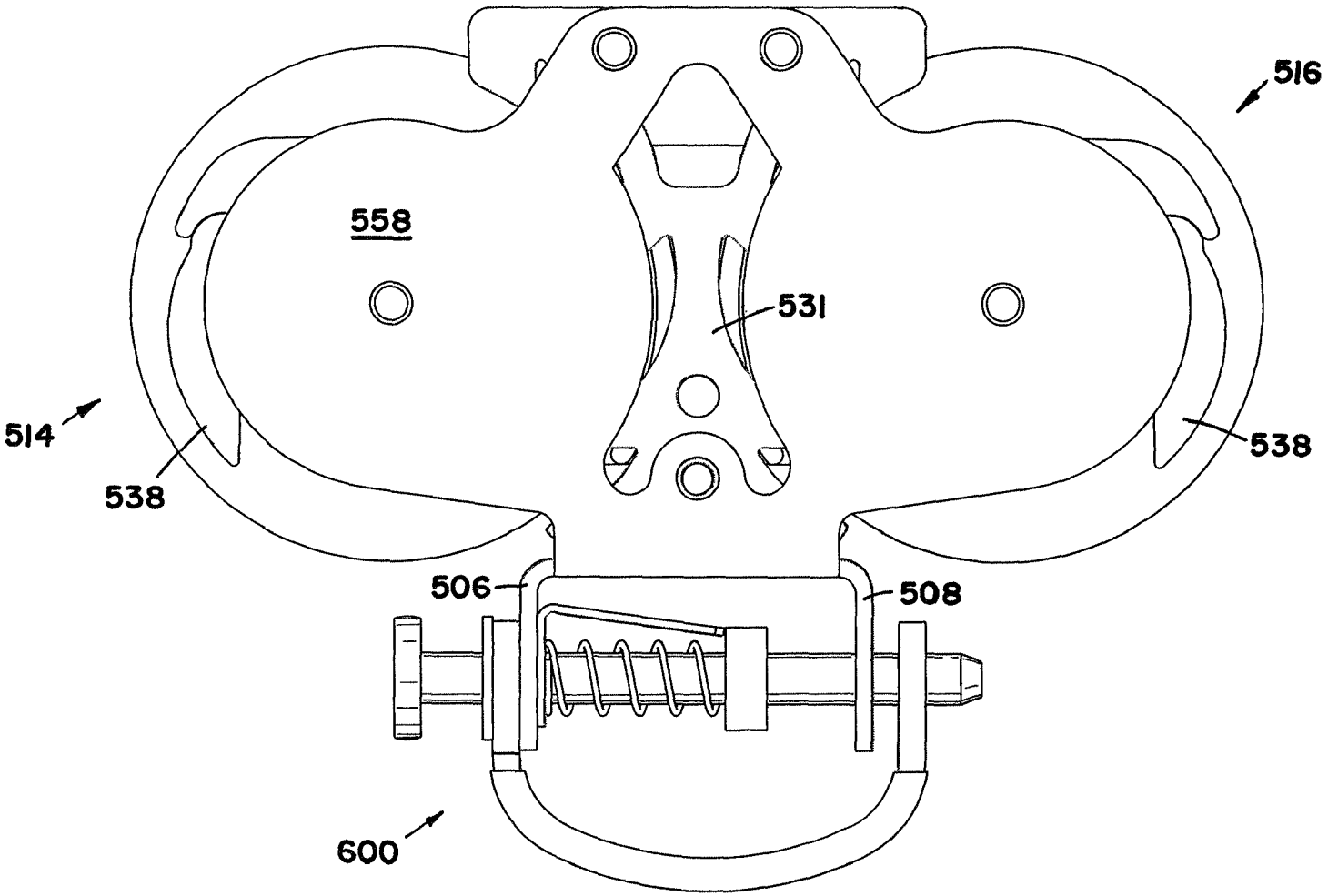
FIG. 24 is a rear view of the self-retracting lifeline shown in FIG. 23 with the housing removed.
Figure 25:
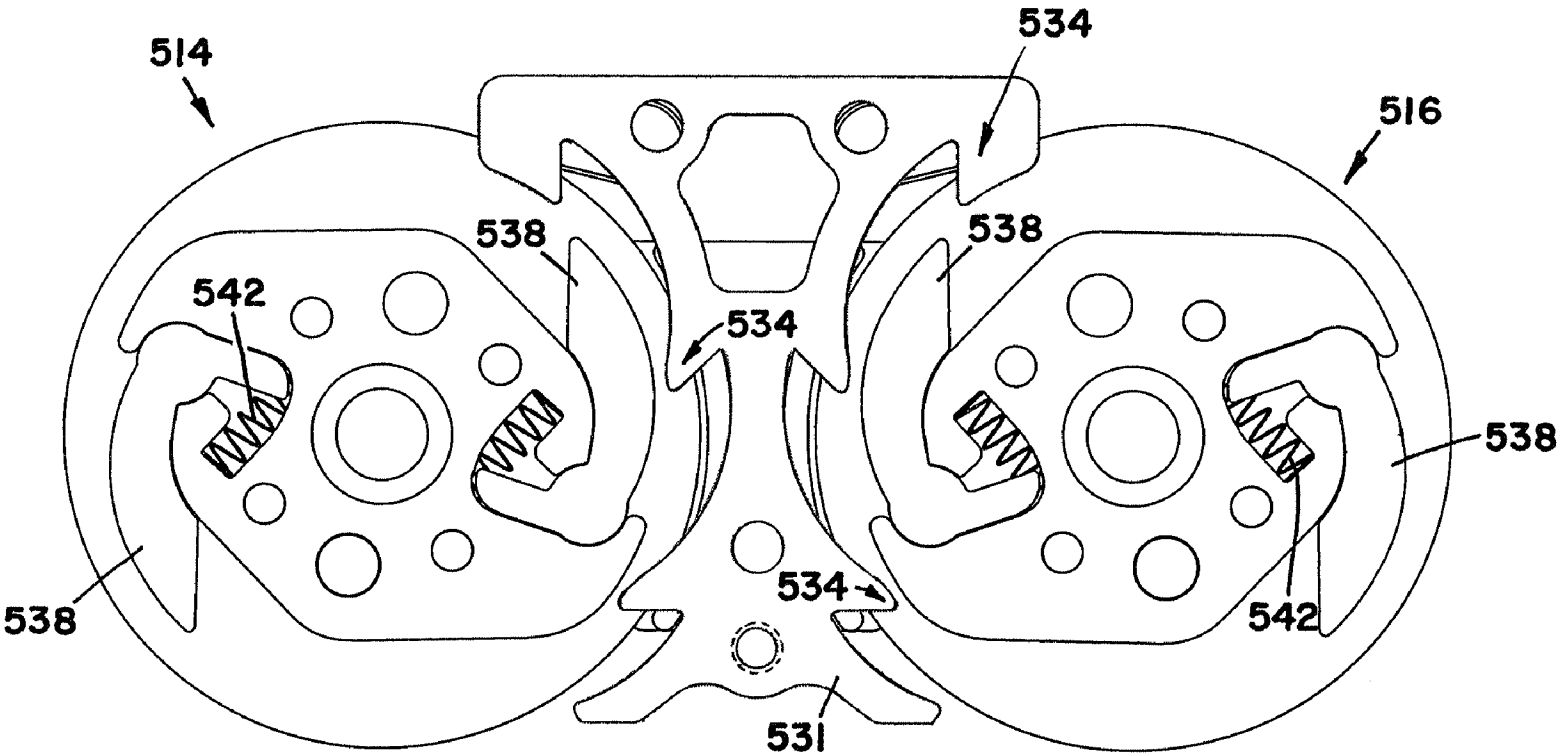
FIG. 25 is a rear view of the self-retracting lifeline shown in FIG. 24 with the plate member removed.
Figure 27:
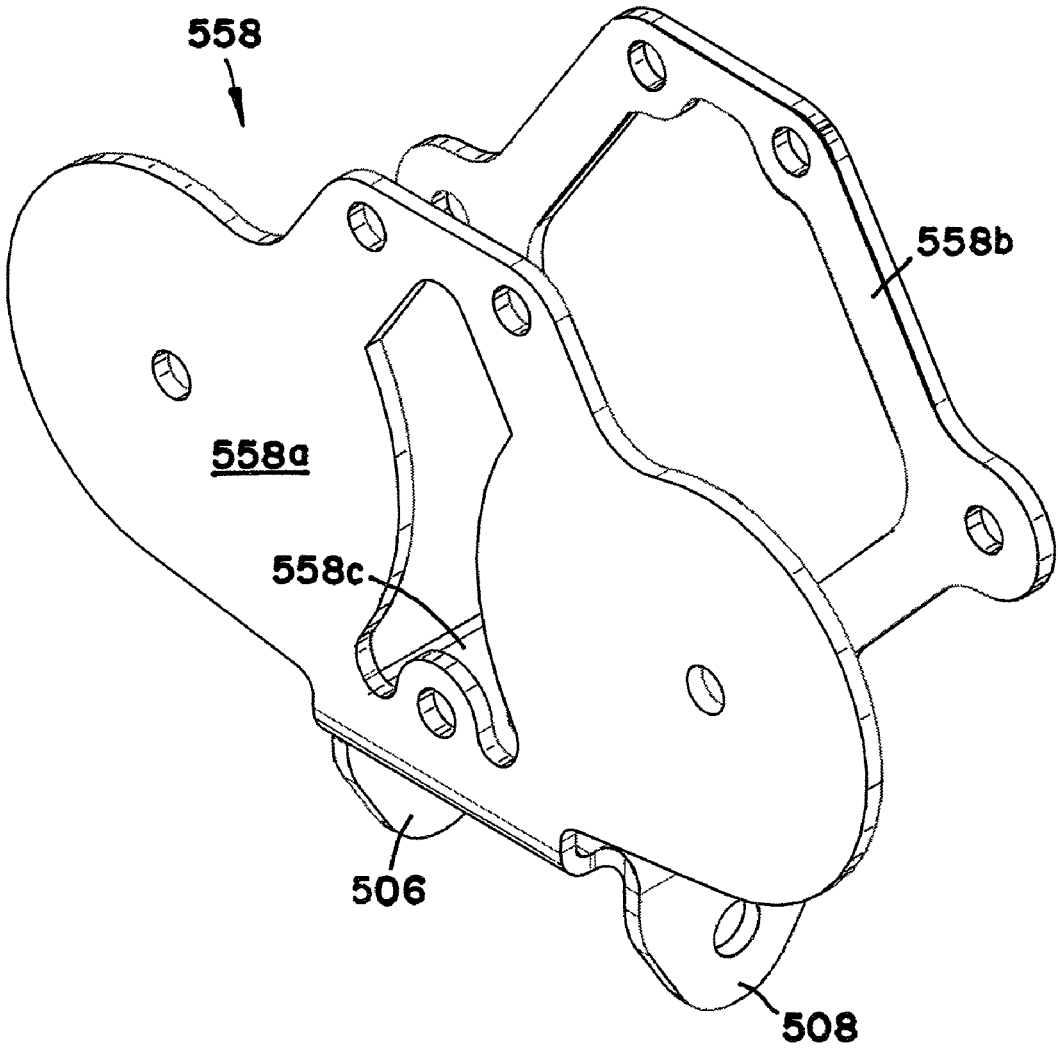
FIG. 27 is a perspective view of a plate member of the self-retracting lifeline shown in FIG. 25.

The plate member 558, shown in FIGS. 24 and 27, is preferably a generally U-shaped member including a connecting portion 558*c* interconnecting a front plate 558*a* and a rear plate 558*b* extending upward from opposing sides of the connecting portion 558*c* parallel to one another. The flanges 506 and 508 are preferably integral with the connecting portion 558*c* and extend downward from opposing sides of the connecting portion 558*c* parallel to one another and perpendicular to the front and rear plates 558*a* and 558*b*. A hub 531 and the first and second cable assemblies 514 and 516, which are shown in FIG. 25, are connected to the plate member 558 between the front and rear plates 558*a* and 558*b*. The hub 531 is positioned between the first and second cable assemblies 514 and 516 and includes teeth 534 configured and arranged to engage the pawls 538 of the first and second cable assemblies 514 and 516 should a fall occur. The springs 542 bias the pawls 538 in an operating position, which allows the cables to be paid out from and wound about the drum. The sudden acceleration or high rate of speed at which the drum turns to pay out cable causes the pawls 538 to overcome the forces of the springs 542 and to pivot to engage the teeth 534 positioning the assembly into a locked, engaged position so that additional cable cannot be paid out from the drum.

An advantage to using a self-retracting lifeline rather than a shock-absorbing lanyard is that a self-retracting lifeline will reduce the fall distance should a fall occur.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A self-retracting lifeline assembly, comprising:

a) a brake hub including teeth on opposing first and second sides, the teeth being integral with the brake hub on the first and second sides;

b) a first lifeline assembly including a first lifeline wound about a first drum and a first centrifugal clutch assembly with a first pawl operatively connected to the first drum, the first drum being rotatable to pay-out the first lifeline, the first pawl being pivotable and configured and arranged to engage at least one of the teeth proximate the first side of the brake hub when the first pawl pivots in a first outward direction, wherein sudden acceleration of the first drum causes the first pawl to pivot in the first outward direction to engage the at least one of the teeth thereby stopping rotation of the first drum and preventing additional pay-out of the first lifeline; and c) a second lifeline assembly including a second lifeline wound about a second drum and a second centrifugal clutch assembly with a second pawl operatively connected to the second drum, the second drum being rotatable to pay-out the second lifeline, the second pawl being pivotable and configured and arranged to engage at least one of the teeth proximate the second side of the brake hub when the second pawl pivots in a second outward direction, wherein sudden acceleration of the second drum causes the second pawl to pivot in the second outward direction to engage the at least one of the teeth thereby stopping rotation of the second drum and preventing additional pay-out of the second lifeline.

2. The self-retracting lifeline assembly of claim 1, further comprising a housing defining a cavity having a first portion, a second portion, and an intermediate portion interconnecting the first portion and the second portion, the brake hub being positioned within the cavity proximate the intermediate portion, the first lifeline assembly being positioned within the cavity proximate the first portion, and the second lifeline assembly being positioned within the cavity proximate the second portion.

3. The self-retracting lifeline assembly of claim 2, further comprising a connector and a connecting strap operatively connected to the housing to releasably connect the housing to shoulder straps of a safety harness proximate a dorsal pad assembly.

4. The self-retracting lifeline assembly of claim 2, wherein the first lifeline and the second lifeline extend out of the housing through an opening.

5. The self-retracting lifeline assembly of claim 4, wherein the opening includes a spacer dividing the opening into a first portion and a second portion, the first lifeline extending through the first portion and the second lifeline extending through the second portion.

6. The self-retracting lifeline assembly of claim 4, wherein the opening is integral with the housing.

7. A self-retracting lifeline assembly, comprising:

a) a housing defining a cavity having a first portion, a second portion, and an intermediate portion interconnecting the first portion and the second portion;

b) a brake hub configured and arranged to be housed within the intermediate portion, the brake hub including teeth on opposing sides proximate the first portion and the second portion, the teeth being integral with the brake hub on the opposing sides of the brake hub;

c) a first lifeline assembly configured and arranged to be housed within the first portion, a first lifeline being wound about the first lifeline assembly, the first lifeline assembly rotating within the housing to pay-out the first lifeline;

d) a first centrifugal clutch assembly with a first pawl operatively connected to the first lifeline assembly;

e) a second lifeline assembly configured and arranged to be housed within the second portion, a second lifeline being wound about the second lifeline assembly, the second lifeline assembly rotating within the housing to pay-out the second lifeline;

f) a second centrifugal clutch assembly with a second pawl operatively connected to the second lifeline assembly; and g) wherein the first pawl is configured and arranged to engage at least one of the respective teeth of the brake hub to stop rotation of the first lifeline assembly when there is a sudden acceleration at which the first lifeline assembly turns to pay-out the first lifeline causing the first pawl to pivot and engage the at least one of the respective teeth thereby preventing additional pay-out of the first lifeline, and wherein the second pawl is configured and arranged to engage at least one of the respective teeth of the brake hub to stop rotation of the second lifeline assembly when there is a sudden acceleration at which the second lifeline assembly turns to pay-out the second lifeline causing the second pawl to pivot and engage the at least one of the respective teeth thereby preventing additional pay-out of the second lifeline.

8. The self-retracting lifeline assembly of claim 7, further comprising:

a) a safety harness including shoulder straps routed through slots in a dorsal pad assembly;

b) a connector operatively connected to a bottom portion of the housing and configured and arranged to be releasably connected to the shoulder straps proximate the dorsal pad assembly; and c) a connecting strap operatively connected to a top portion of the housing and configured and arranged to be releasably connected to the shoulder straps proximate above the dorsal pad assembly, the first and second lifelines being paid-out from the top portion of the housing.

9. The self-retracting lifeline assembly of claim 7, wherein the first lifeline and the second lifeline extend out of the housing through an opening.

10. The self-retracting lifeline assembly of claim 9, wherein the opening includes a spacer dividing the opening into a first portion and a second portion, the first lifeline extending through the first portion and the second lifeline extending through the second portion.

11. The self-retracting lifeline assembly of claim 9, wherein the opening is integral with the housing.

* * * * *